US010895142B2

(12) United States Patent
Jeffryes et al.

(10) Patent No.: US 10,895,142 B2
(45) Date of Patent: Jan. 19, 2021

(54) CONTROLLING DRILL STRING ROTATION

(71) Applicant: SCHLUMBERGER TECHNOLOGY CORPORATION, Sugar Land, TX (US)

(72) Inventors: Benjamin Peter Jeffryes, Histon (GB); Nathaniel Wicks, Somerville, MA (US); Shunfeng Zheng, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/809,366

(22) Filed: Mar. 4, 2020

(65) Prior Publication Data

US 2020/0199994 A1 Jun. 25, 2020

Related U.S. Application Data

(63) Continuation of application No. PCT/US2018/049321, filed on Sep. 4, 2018.

(60) Provisional application No. 62/554,239, filed on Sep. 5, 2017.

(51) Int. Cl.

| | |
|---|---|
| ***E21B 3/035*** | (2006.01) |
| ***E21B 44/00*** | (2006.01) |
| ***E21B 3/02*** | (2006.01) |

(52) U.S. Cl.

CPC ..... *E21B 44/00* (2013.01); *E21B 3/02* (2013.01); *E21B 3/035* (2013.01)

(58) Field of Classification Search

CPC ..... E21B 3/035; E21B 44/00; E21B 31/00; E21B 3/02

See application file for complete search history.

(56) References Cited

U.S. PATENT DOCUMENTS

| | | | |
|---|---|---|---|
| 5,117,926 | A | 6/1992 | Norrall et al. |
| 6,050,348 | A | 4/2000 | Richarson et al. |
| 6,166,654 | A | 12/2000 | Van Den Steen |
| 6,327,539 | B1 | 12/2001 | Keultjes et al. |
| 6,338,390 | B1 | 1/2002 | Tibbitts |

(Continued)

FOREIGN PATENT DOCUMENTS

| | | | |
|---|---|---|---|
| EP | 2549055 | A2 | 1/2013 |
| WO | 2010063982 | A1 | 6/2010 |

(Continued)

OTHER PUBLICATIONS

Halsey, Kyllingstad, and Kylling, "Torque Feedback Used to Cure Slip-Stick Motion," SPE 18049, 63rd Annual Technical Conference and Exhibition of the Society of Petroleum Engineers, Oct. 2-5, 1988; pp. 277-282.

*Primary Examiner* — Daniel P Stephenson

(74) *Attorney, Agent, or Firm* — Rachel E. Greene

(57) ABSTRACT

Methods and apparatus for controlling drill string rotation. The apparatus may be a control system for controlling a driver operable to rotate a drill string to form a wellbore extending into a subterranean formation. The control system may include a first controller operable to control rotation of the driver and a second controller communicatively connected with the first controller. During the drilling operations the first and/or second controller may be operable to generate a rotational speed command based on status information indicative of operational status of the drill string, and thereby cause the driver to rotate the drill string based on the rotational speed command.

22 Claims, 12 Drawing Sheets

(56) References Cited

U.S. PATENT DOCUMENTS

| | | | | |
|---|---|---|---|---|
| 6,382,331 | B1 | 5/2002 | Pinckard | |
| 7,152,696 | B2 | 12/2006 | Jones | |
| 7,404,454 | B2 | 7/2008 | Hulick | |
| 7,461,705 | B2 | 12/2008 | Hulick et al. | |
| 7,588,100 | B2 | 9/2009 | Hamilton | |
| 7,802,634 | B2 | 9/2010 | Boone | |
| 7,823,655 | B2 | 11/2010 | Boone et al. | |
| 8,360,171 | B2 | 1/2013 | Boone et al. | |
| 8,387,720 | B1 | 3/2013 | Keast et al. | |
| 8,528,663 | B2 | 9/2013 | Boone | |
| 8,602,126 | B2 | 12/2013 | Boone et al. | |
| 8,672,055 | B2 | 3/2014 | Boone et al. | |
| 8,689,906 | B2 | 4/2014 | Nessjoen et al. | |
| RE44,956 | E | 6/2014 | Richardson et al. | |
| RE44,973 | E | 7/2014 | Richardson et al. | |
| 8,833,488 | B2 | 9/2014 | Knudsen et al. | |
| 8,939,233 | B2 | 1/2015 | Edbury et al. | |
| 8,939,234 | B2 | 1/2015 | Mebane, III et al. | |
| 8,950,512 | B2 | 2/2015 | Nessjoen et al. | |
| 9,249,655 | B1 | 2/2016 | Keast et al. | |
| 9,290,995 | B2 | 3/2016 | Boone et al. | |
| 9,359,881 | B2 | 6/2016 | DiSantis | |
| 9,424,667 | B2 | 8/2016 | Pena et al. | |
| 9,429,008 | B2 * | 8/2016 | Beylotte | E21B 44/00 |
| 9,506,336 | B2 | 11/2016 | Orbell | |
| 9,581,008 | B2 | 2/2017 | Kyllingstad | |
| 9,593,567 | B2 | 3/2017 | Pink et al. | |
| 9,598,947 | B2 | 3/2017 | Wang et al. | |
| 9,650,880 | B2 | 5/2017 | Bowley et al. | |
| 9,689,250 | B2 * | 6/2017 | Badkoubeh | E21B 3/035 |
| 10,094,209 | B2 * | 10/2018 | Gillan | E21B 23/14 |
| 2011/0232966 | A1 | 9/2011 | Kyllingstad | |
| 2014/0110167 | A1 | 4/2014 | Goebel et al. | |
| 2014/0277752 | A1 | 9/2014 | Chang et al. | |
| 2014/0305702 | A1 | 10/2014 | Bowley et al. | |
| 2015/0107897 | A1 | 4/2015 | Nessjoen et al. | |
| 2015/0240615 | A1 * | 8/2015 | Dykstra | E21B 44/005 700/275 |
| 2016/0168973 | A1 | 6/2016 | Dykstra et al. | |
| 2016/0194649 | A1 | 7/2016 | Yohn | |
| 2016/0237802 | A1 | 8/2016 | Boone et al. | |
| 2016/0273332 | A1 | 9/2016 | Dwars et al. | |
| 2016/0281488 | A1 | 9/2016 | Dwars et al. | |
| 2017/0101861 | A1 | 4/2017 | Kyllingstad | |
| 2018/0073344 | A1 | 3/2018 | Patterson et al. | |
| 2020/0157927 | A1 * | 5/2020 | Younes | E21B 44/00 |
| 2020/0199994 | A1 * | 6/2020 | Jeffryes | E21B 3/02 |
| 2020/0284135 | A1 * | 9/2020 | Benson | E21B 47/024 |

FOREIGN PATENT DOCUMENTS

| | | | | |
|---|---|---|---|---|
| WO | 2017083454 | A1 | 5/2017 | |
| WO | WO-2019050824 | A1 * | 3/2019 | E21B 31/00 |

* cited by examiner

CONTROLLING DRILL STRING ROTATION

CROSS-REFERENCE TO RELATED APPLICATIONS

This application is a 35 U.S.C. § 111(a) application of International Application No. PCT/US2018/049321 filed Sep. 4, 2018, which claims priority to and the benefit of U.S. Provisional Application No. 62/554,239, titled "METHOD AND APPARATUS FOR DRILL STRING ROTATIONAL VIBRATION CONTROL," filed Sep. 5, 2017. The entire disclosure including the specification and figures of both applications are hereby incorporated by reference herein.

BACKGROUND OF THE DISCLOSURE

Wells are generally drilled into the ground or ocean bed to recover natural deposits of oil, gas, and other materials that are trapped in subterranean formations. Drilling operations may be performed by drilling systems having various surface and subterranean equipment operating in a coordinated manner. For example, a drive mechanism ("driver"), such as a top drive or rotary table located at a wellsite surface, can be used to rotate and advance a drill string into a subterranean formation to drill a wellbore. A drill string may include a plurality of drill pipes coupled together and terminating with a drill bit. Length of the drill string may be increased by adding additional drill pipes while depth of the wellbore increases. Wellbores can reach lengths of several kilometers vertically and/or horizontally.

During drilling operations, a drill string undergoes complicated dynamic behavior, including experiencing axial, lateral, and rotational vibrations, as well as frictional interactions with bottom and sidewalls of the wellbore being drilled. Rotational speed (i.e., angular velocity) measurements of the drill string taken at the wellsite surface (e.g., at the driver) and downhole (e.g., at the drill bit) have revealed that while top of the drill string rotates with a substantially constant rotational speed, lower portions of the drill string often rotate with varying rotational speeds. For example, a drill string may experience stick-slip motion, whereby a drill bit stops rotating (sticks) in a wellbore, such as due to friction, while top of the drill string continues to be rotated by a driver, twisting the drill string. When the drill bit becomes free and rotates again (slips), it accelerates to a rotational speed that may be higher than the rotational speed of the top of the drill string.

Such stick-slip motion may cause rotational (i.e., torsional) waves (e.g., oscillations, vibrations) that propagate or otherwise travel in an upward (i.e., uphole) and/or downward (i.e., downhole) directions along a drill string while the drill string is rotated within a wellbore. The upward traveling rotational waves may be reflected at the wellsite surface (e.g., by the driver) and travel downward, causing rotational wave resonances and additional stick-slip motion along and/or at the bottom of the drill string. In drill strings having larger diameter drill pipe sections near the wellsite surface, some of the upward traveling rotational waves may be reflected before they reach the surface, which may make surface control of the stick-slip motion more difficult because the waves are not observable at the surface. Stick-slip motion and the resulting rotational waves in the drill string are a recognized problem in the drilling industry and may result in a reduced rate of penetration through the subterranean formation, bit wear, torsional damage to the drill string, failures or damage to the surface driver, and/or other damage to the drilling system.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a control system for controlling a driver operable to rotate a drill string to form a wellbore extending into a subterranean formation. The control system includes a first controller to control rotation of the driver, and a second controller communicatively connected with the first controller. During the drilling operations, the first and/or second controller generates a rotational speed command based on status information indicative of operational status of the drill string, and thereby causes the driver to rotate the drill string based on the rotational speed command.

The present disclosure also introduces an apparatus including a control system to control a well construction system, wherein the control system includes a first tier of controllers each controlling a corresponding actuator of the well construction system, a second tier of controllers each communicatively connected with a corresponding instance of the first tier of controllers, and a third controller communicatively connected with each instance of the second tier of controllers. The first tier of controllers include a first controller to control rotation of a driver to rotate a drill string to form a wellbore extending into a subterranean formation. The second tier of controllers includes a second controller communicatively connected with the first controller. The first, second, and/or third controller include a processor and a memory storing executable program code instructions include a stick-slip algorithm. The first, second, and/or third controller receive input parameters of the stick-slip algorithm. During drilling operations, the first, second, and/or third controller execute the program code instructions to generate a rotational speed command based on the input parameters and on status information indicative of operational status of the drill string, and thereby cause the driver to vary rotational speed of the drill string based on the rotational speed command to reduce rotational waves traveling along the drill string.

The present disclosure also introduces a method including operating a first controller to cause a driver to rotate a drill string to form a wellbore extending into a subterranean formation, operating a second controller communicatively connected with the first controller, operating a third controller communicatively connected with the second controller, generating status information indicative of operational status of the drill string, and executing (by the first, second, and/or third controller) program code instructions including a stick-slip algorithm to generate a rotational speed command based on the status information, thereby causing the driver to vary rotational speed of the drill string based on the rotational speed command to reduce rotational waves traveling along the drill string.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
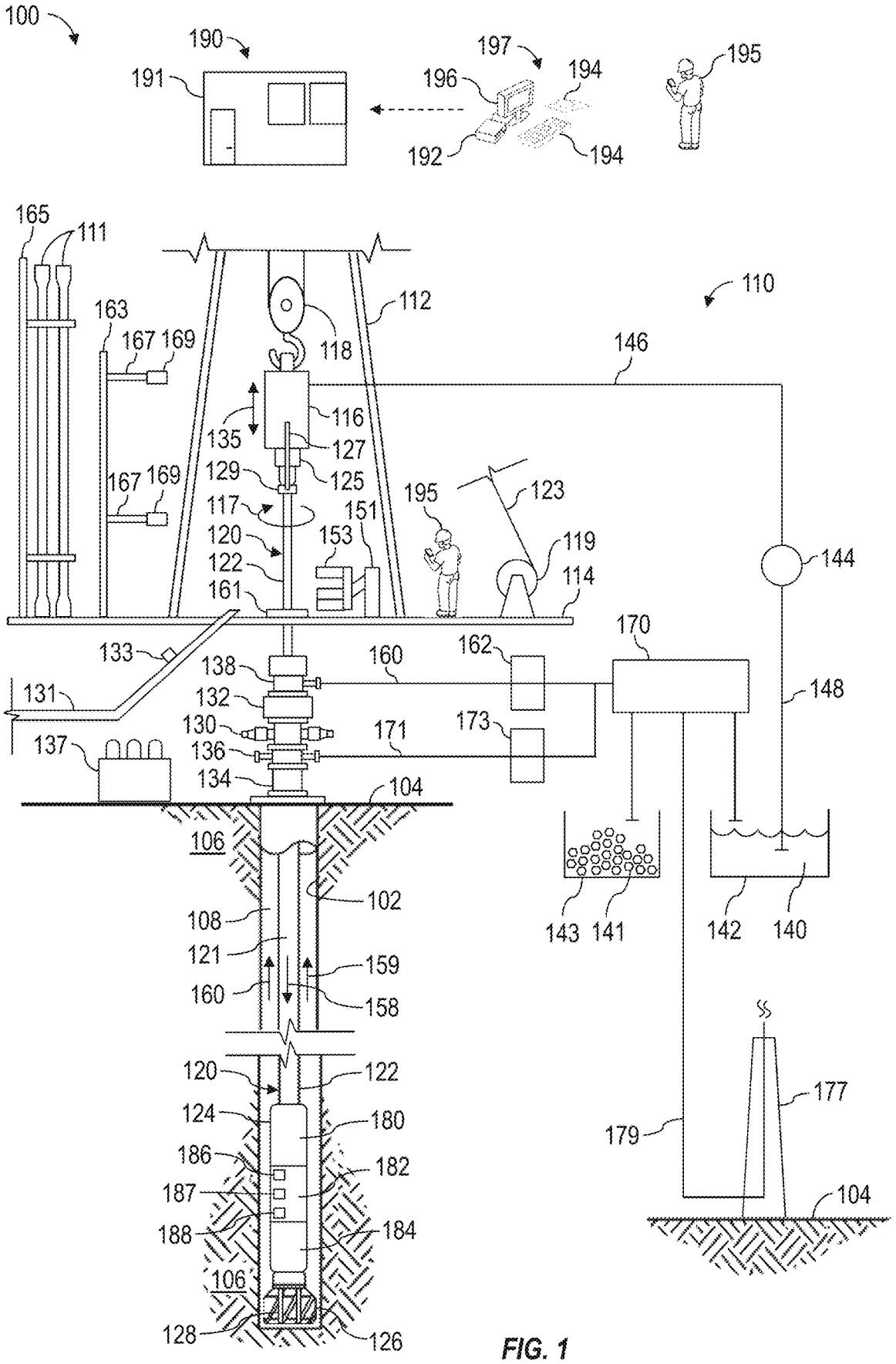
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed.

Systems and methods (e.g., processes, operations) according to one or more aspects of the present disclosure may be used or performed in association with a well construction system at a wellsite, such as for constructing a wellbore to obtain hydrocarbons (e.g., oil and/or gas) from a subterranean formation. For example, some aspects of the present disclosure may be described in the context of drilling a wellbore in the oil and gas industry. However, one or more aspects of the present disclosure may be utilized in other drilling industries and/or in association with other drilling systems. A person having ordinary skill in the art will readily understand that one or more aspects of systems and methods disclosed herein may be utilized in other industries and/or in association with other systems.

Aspects of the present disclosure may be directed to a control system for controlling a driver operable to rotate a drill string to form a wellbore extending into a subterranean formation. The control system may comprise an equipment controller comprising a processor and a memory storing executable program code instructions comprising a stick-slip algorithm, which when executed by the processor of the equipment controller, may cause the equipment controller to receive status information indicative of operational status of the drill string and input parameters of the stick-slip algorithm. During drilling operations the equipment controller may be further caused to generate a rotational speed command based on the status information and input parameters, thereby causing the driver to vary rotational speed of the drill string based on the rotational speed command to reduce rotational waves traveling along the drill string.

FIG. 1 is a schematic view of at least a portion of an example implementation of a well construction system 100 according to one or more aspects of the present disclosure. The well construction system 100 represents an example environment in which one or more aspects of the present disclosure described below may be implemented. Although the well construction system 100 is depicted as an onshore implementation, the aspects described below are also applicable to offshore implementations.

The well construction system 100 is depicted in relation to a wellbore 102 formed by rotary and/or directional drilling from a wellsite surface 104 and extending into a subterranean formation 106. The well construction system 100 includes surface equipment 110 located at the wellsite surface 104 and a drill string 120 suspended within the wellbore 102. The surface equipment 110 may include a mast, a derrick, and/or another support structure 112 disposed over a rig floor 114. The drill string 120 may be suspended within the wellbore 102 from the support structure 112. The support structure 112 and the rig floor 114 are collectively supported over the wellbore 102 by legs and/or other support structures (not shown).

The drill string 120 may comprise a bottom-hole assembly (BHA) 124 and means 122 for conveying the BHA 124 within the wellbore 102. The conveyance means 122 may comprise drill pipe, heavy-weight drill pipe (HWDP), wired drill pipe (WDP), tough logging condition (TLC) pipe, coiled tubing, and/or other means for conveying the BHA 124 within the wellbore 102. A downhole end of the BHA 124 may include or be coupled to a drill bit 126. Rotation of the drill bit 126 and the weight of the drill string 120 collectively operate to form the wellbore 102. The drill bit 126 may be rotated from the wellsite surface 104 and/or via a downhole mud motor (not shown) connected with the drill bit 126.

The BHA 124 may also include various downhole tools 180, 182, 184. One or more of such downhole tools 180, 182, 184 may be or comprise an acoustic tool, a density tool, a directional drilling tool, an electromagnetic (EM) tool, a formation sampling tool, a formation testing tool, a gravity tool, a monitoring tool, a neutron tool, a nuclear tool, a photoelectric factor tool, a porosity tool, a reservoir characterization tool, a resistivity tool, a rotational speed sensing tool, a sampling-while-drilling (SWD) tool, a seismic tool, a surveying tool, a torsion sensing tool, and/or other measuring-while-drilling (MWD) or logging-while-drilling (LWD) tools.

One or more of the downhole tools 180, 182, 184 may be or comprise an MWD or LWD tool comprising a sensor package 186 operable for the acquisition of measurement data pertaining to the BHA 124, the wellbore 102, and/or the formation 106. One or more of the downhole tools 180, 182, 184 and/or another portion of the BHA 124 may also comprise a telemetry device 187 operable for communication with the surface equipment 110, such as via mud-pulse telemetry. One or more of the downhole tools 180, 182, 184 and/or another portion of the BHA 124 may also comprise a downhole processing device 188 operable to receive, process, and/or store information received from the surface equipment 110, the sensor package 186, and/or other portions of the BHA 124. The processing device 188 may also store executable computer programs (e.g., program code instructions), including for implementing one or more aspects of the operations described herein.

The support structure 112 may support a driver, such as a top drive 116, operable to connect (perhaps indirectly) with an uphole end of the conveyance means 122, and to impart rotary motion 117 and vertical motion 135 to the drill string 120 and the drill bit 126. However, another driver, such as a kelly and rotary table (neither shown), may be utilized instead of or in addition to the top drive 116 to impart the rotary motion 117. The top drive 116 and the connected drill string 120 may be suspended from the support structure 112 via hoisting equipment, which may include a traveling block 118, a crown block (not shown), and a draw works 119 storing a support cable or line 123. The crown block may be connected to or otherwise supported by the support structure 112, and the traveling block 118 may be coupled with the top drive 116, such as via a hook. The draw works 119 may be mounted on or otherwise supported by the rig floor 114. The crown block and traveling block 118 comprise pulleys or sheaves around which the support line 123 is reeved to operatively connect the crown block, the traveling block 118, and the draw works 119 (and perhaps an anchor). The draw works 119 may thus selectively impart tension to the support line 123 to lift and lower the top drive 116, resulting in the vertical motion 135. The draw works 119 may comprise a drum, a frame, and a prime mover (e.g., an engine or motor) (not shown) operable to drive the drum to rotate and reel in the support line 123, causing the traveling block 118 and the top drive 116 to move upward. The draw works 119 may be operable to release the support line 123 via a controlled rotation of the drum, causing the traveling block 118 and the top drive 116 to move downward.

The top drive 116 may comprise a grabber, a swivel (neither shown), a tubular handling assembly 127 terminating with an elevator 129, and a drive shaft 125 operatively connected with a prime mover (not shown), such as via a gear box or transmission (not shown). The drill string 120 may be mechanically coupled to the drive shaft 125 with or without a sub saver between the drill string 120 and the drive shaft 125. The prime mover may be selectively operated to rotate the drive shaft 125 and the drill string 120 coupled with the drive shaft 125. Hence, during drilling operations, the top drive 116 in conjunction with operation of the draw works 119 may advance the drill string 120 into the formation 106 to form the wellbore 102. The tubular handling assembly 127 and the elevator 129 of the top drive 116 may handle tubulars (e.g., drill pipes, drill collars, casing joints, etc.) that are not mechanically coupled to the drive shaft 125. For example, when the drill string 120 is being tripped into or out of the wellbore 102, the elevator 129 may grasp the tubulars of the drill string 120 such that the tubulars may be raised and/or lowered via the hoisting equipment mechanically coupled to the top drive 116. The grabber may include a clamp that clamps onto a tubular when making up and/or breaking out a connection of a tubular with the drive shaft 125. The top drive 116 may have a guide system (not shown), such as rollers that track up and down a guide rail on the support structure 112. The guide system may aid in keeping the top drive 116 aligned with the wellbore 102, and in preventing the top drive 116 from rotating during drilling by transferring reactive torque to the support structure 112.

The well construction system 100 may further include a well control system for maintaining well pressure control. For example, the drill string 120 may be conveyed within the wellbore 102 through various blowout preventer (BOP) equipment disposed at the wellsite surface 104 on top of the wellbore 102 and perhaps below the rig floor 114. The BOP equipment may be operable to control pressure within the wellbore 102 via a series of pressure barriers (e.g., rams) between the wellbore 102 and the wellsite surface 104. The BOP equipment may include a BOP stack 130, an annular preventer 132, and/or a rotating control device (RCD) 138 mounted above the annular preventer 132. The BOP equipment 130, 132, 138 may be mounted on top of a wellhead 134. The well control system may further include a BOP control unit 137 (i.e., a BOP closing unit) operatively connected with the BOP equipment 130, 132, 138 and operable to actuate, drive, operate or otherwise control the BOP equipment 130, 132, 138. The BOP control unit 137 may be or comprise a hydraulic fluid power unit fluidly connected with the BOP equipment 130, 132, 138 and selectively operable to hydraulically drive various portions (e.g., rams, valves, seals) of the BOP equipment 130, 132, 138.

The well construction system 100 may further include a drilling fluid circulation system operable to circulate fluids between the surface equipment 110 and the drill bit 126 during drilling and other operations. For example, the drilling fluid circulation system may be operable to inject a drilling fluid from the wellsite surface 104 into the wellbore 102 via an internal fluid passage 121 extending longitudinally through the drill string 120. The drilling fluid circulation system may comprise a pit, a tank, and/or other fluid container 142 holding drilling fluid (i.e., mud) 140, and a pump 144 operable to move the drilling fluid 140 from the container 142 into the fluid passage 121 of the drill string 120 via a fluid conduit 146 extending from the pump 144 to the top drive 116 and an internal passage extending through the top drive 116. The fluid conduit 146 may comprise one or more of a pump discharge line, a stand pipe, a rotary hose, and a gooseneck (not shown) connected with a fluid inlet of the top drive 116. The pump 144 and the container 142 may be fluidly connected by a fluid conduit 148, such as a suction line.

During drilling operations, the drilling fluid may continue to flow downhole through the internal passage 121 of the drill string 120, as indicated by directional arrow 158. The drilling fluid may exit the BHA 124 via ports 128 in the drill bit 126 and then circulate uphole through an annular space 108 ("annulus") of the wellbore 102 defined between an exterior of the drill string 120 and the wall of the wellbore 102, such flow being indicated by directional arrows 159. In this manner, the drilling fluid 140 lubricates the drill bit 126 and carries formation cuttings uphole to the wellsite surface 104. The returning drilling fluid may exit the annulus 108 via the RCD 138 and/or via a spool, a wing valve, a bell nipple, or another ported adapter 136, which may be located below one or more portions of the BOP stack 130.

The drilling fluid exiting the annulus 108 via the RCD 138 may be directed into a fluid conduit 160 (e.g., a drilling pressure control line), and may pass through various wellsite equipment fluidly connected along the conduit 160 prior to being returned to the container 142 for recirculation. For example, the drilling fluid may pass through a choke manifold 162 (e.g., a drilling pressure control choke manifold) connected along the conduit 160. The choke manifold 162 may include at least one choke and a plurality of fluid valves (neither shown) collectively operable to control the flow through and out of the choke manifold 162. Backpressure may be applied to the annulus 108 by variably restricting flow of the drilling fluid or other fluids flowing through the choke manifold 162. The greater the restriction to flow through the choke manifold 162, the greater the backpressure applied to the annulus 108.

The drilling fluid may also or instead exit the annulus 108 via the ported adapter 136 and into a fluid conduit 171 (e.g., rig choke line), and may pass through various equipment fluidly connected along the conduit 171 prior to being returned to the container 142 for recirculation. For example, the drilling fluid may pass through a choke manifold 173 (e.g., a rig choke manifold) connected along the conduit 171. The choke manifold 173 may include at least one choke and a plurality of fluid valves (neither shown) collectively operable to control the flow through the choke manifold 173. Backpressure may be applied to the annulus 108 by variably restricting flow of the drilling fluid or other fluids flowing through the choke manifold 173.

Before being returned to the container 142, the drilling fluid returning to the wellsite surface 104 may be cleaned and/or reconditioned via drilling fluid reconditioning equipment 170, which may include one or more of liquid gas separators, shale shakers, centrifuges, and other drilling fluid cleaning equipment. The liquid gas separators may remove formation gasses entrained in the drilling fluid discharged from the wellbore 102 and the shale shakers may separate and remove solid particles 141 (e.g., drill cuttings) from the drilling fluid. The drilling fluid reconditioning equipment 170 may further comprise equipment operable to remove additional gas and finer formation cuttings from the drilling fluid and/or modify physical properties or characteristics (e.g., rheology) of the drilling fluid. For example, the drilling fluid reconditioning equipment 170 may include a degasser, a desander, a desilter, a mud cleaner, and/or a decanter, among other examples. Intermediate tanks/containers (not shown) may be utilized to hold the drilling fluid 140 while the drilling fluid progresses through the various stages or portions of the drilling fluid reconditioning equipment 170. The cleaned/reconditioned drilling fluid may be transferred to the fluid container 142, the solid particles 141 removed from the drilling fluid may be transferred to a solids container 143 (e.g., a reserve pit), and/or the removed gas may be transferred to a flare stack 177 via a conduit 179 (e.g., a flare line) to be burned or to a container (not shown) for storage and removal from the wellsite.

The surface equipment 110 may include tubular handling equipment operable to store, move, connect, and disconnect tubulars (e.g., drill pipes) to assemble and disassemble the conveyance means 122 of the drill string 120 during drilling operations. For example, a catwalk 131 may be utilized to convey tubulars from a ground level, such as along the wellsite surface 104, to the rig floor 114, permitting the tubular handling assembly 127 to grab and lift the tubulars above the wellbore 102 for connection with previously deployed tubulars. The catwalk 131 may have a horizontal portion and an inclined portion that extends between the horizontal portion and the rig floor 114. The catwalk 131 may comprise a skate 133 movable along a groove (not shown) extending longitudinally along the horizontal and inclined portions of the catwalk 131. The skate 133 may be operable to convey (e.g., push) the tubulars along the catwalk 131 to the rig floor 114. The skate 133 may be driven along the groove by a drive system (not shown), such as a pulley system or a hydraulic system. Additionally, one or more racks (not shown) may adjoin the horizontal portion of the catwalk 131. The racks may have a spinner unit for transferring tubulars to the groove of the catwalk 131.

An iron roughneck 151 may be positioned on the rig floor 114. The iron roughneck 151 may comprise a torqueing portion 153, such as may include a spinner and a torque wrench comprising a lower tong and an upper tong. The torqueing portion 153 of the iron roughneck 151 may be moveable toward and at least partially around the drill string 120, such as may permit the iron roughneck 151 to make up and break out connections of the drill string 120. The torqueing portion 153 may also be moveable away from the drill string 120, such as may permit the iron roughneck 151 to move clear of the drill string 120 during drilling operations. The spinner of the iron roughneck 151 may be utilized to apply low torque to make up and break out threaded connections between tubulars of the drill string 120, and the torque wrench may be utilized to apply a higher torque to tighten and loosen the threaded connections.

A reciprocating slip 161 may be located on the rig floor 114, such as may accommodate therethrough the conveyance means 122 during make up and break out operations and during the drilling operations. The reciprocating slip 161 may be in an open position during drilling operations to permit advancement of the drill string 120 therethrough, and in a closed position to clamp an upper end of the conveyance means 122 (e.g., assembled tubulars) to thereby suspend and prevent advancement of the drill string 120 within the wellbore 102, such as during the make up and break out operations.

During drilling operations, the hoisting equipment lowers the drill string 120 while the top drive 116 rotates the drill string 120 to advance the drill string 120 downward within the wellbore 102 and into the formation 106. During the advancement of the drill string 120, the reciprocating slip 161 is in an open position, and the iron roughneck 151 is moved away or is otherwise clear of the drill string 120. When the upper portion of the tubular in the drill string 120 that is made up to the drive shaft 125 is near the reciprocating slip 161 and/or the rig floor 114, the top drive 116 ceases rotating and the reciprocating slip 161 closes to clamp the tubular made up to the drive shaft 125. The grabber of the top drive 116 then clamps the upper portion of the tubular made up to the drive shaft 125, and the drive shaft 125 rotates in a direction reverse from the drilling rotation to break out the connection between the drive shaft 125 and the made up tubular. The grabber of the top drive 116 may then release the tubular of the drill string 120.

Multiple tubulars may be loaded on the rack of the catwalk 131 and individual tubulars (or stands of two or three tubulars) may be transferred from the rack to the groove in the catwalk 131, such as by the spinner unit. The tubular positioned in the groove may be conveyed along the groove by the skate 133 until an end of the tubular projects above the rig floor 114. The elevator 129 of the top drive 116 then grasps the protruding end, and the draw works 119 is operated to lift the top drive 116, the elevator 129, and the new tubular.

The hoisting equipment then raises the top drive 116, the elevator 129, and the tubular until the tubular is aligned with the upper portion of the drill string 120 clamped by the slip 161. The iron roughneck 151 is moved toward the drill string 120, and the lower tong of the torqueing portion 153 clamps onto the upper portion of the drill string 120. The spinning system rotates the new tubular (e.g., a threaded male end) into the upper portion of the drill string 120 (e.g., a threaded female end). The upper tong then clamps onto the new tubular and rotates with high torque to complete making up the connection with the drill string 120. In this manner, the new tubular becomes part of the drill string 120. The iron roughneck 151 then releases and moves clear of the drill string 120.

The grabber of the top drive 116 may then clamp onto the drill string 120. The drive shaft 125 (e.g., a threaded male end) is brought into contact with the drill string 120 (e.g., a threaded female end) and rotated to make up a connection between the drill string 120 and the drive shaft 125. The grabber then releases the drill string 120, and the reciprocating slip 161 is moved to the open position. The drilling operations may then resume.

The tubular handling equipment may further include a pipe handling manipulator (PHM) 163 disposed in association with a fingerboard 165. Although the PHM 163 and the fingerboard 165 are shown supported on the rig floor 114, one or both of the PHM 163 and fingerboard 165 may be located on the wellsite surface 104 or another area of the well construction system 100. The fingerboard 165 provides storage (e.g., temporary storage) of tubulars (or stands of two or three tubulars) 111 during various operations, such as during and between tripping out and tripping in the drill string 120. The PHM 163 may be operable to transfer the tubulars 111 between the fingerboard 165 and the drill string 120 (i.e., space above the suspended drill string 120). For example, the PHM 163 may include arms 167 terminating with clamps 169, such as may be operable to grasp and/or clamp onto one of the tubulars 111. The arms 167 of the PHM 163 may extend and retract, and/or at least a portion of the PHM 163 may be rotatable and/or movable toward and away from the drill string 120, such as may permit the PHM 163 to transfer the tubular 111 between the fingerboard 165 and the drill string 120.

To trip out the drill string 120, the top drive 116 is raised, the reciprocating slip 161 is closed around the drill string 120, and the elevator 129 is closed around the drill string 120. The grabber of the top drive 116 clamps the upper portion of the tubular made up to the drive shaft 125. The drive shaft 125 then rotates in a direction reverse from the drilling rotation to break out the connection between the drive shaft 125 and the drill string 120. The grabber of the top drive 116 then releases the tubular of the drill string 120, and the drill string 120 is suspended by (at least in part) the elevator 129. The iron roughneck 151 is moved toward the drill string 120. The lower tong clamps onto a lower tubular below a connection of the drill string 120, and the upper tong clamps onto an upper tubular above that connection. The upper tong then rotates the upper tubular to provide a high torque to break out the connection between the upper and lower tubulars. The spinning system then rotates the upper tubular to separate the upper and lower tubulars, such that the upper tubular is suspended above the rig floor 114 by the elevator 129. The iron roughneck 151 then releases the drill string 120 and moves clear of the drill string 120.

The PHM 163 may then move toward the drill string 120 to grasp the tubular suspended from the elevator 129. The elevator 129 then opens to release the tubular. The PHM 163 then moves away from the drill string 120 while grasping the tubular with the clamps 169, places the tubular in the fingerboard 165, and releases the tubular for storage in the fingerboard 165. This process is repeated until the intended length of drill string 120 is removed from the wellbore 102.

The surface equipment 110 of the well construction system 100 may also comprise a control center 190 from which various portions of the well construction system 100, such as the top drive 116, the hoisting system, the tubular handling system, the drilling fluid circulation system, the well control system, the BHA 124, among other examples, may be monitored and controlled. The control center 190 may be located on the rig floor 114 or another location of the well construction system 100, such as the wellsite surface 104. The control center 190 may comprise a facility 191 (e.g., a room, a cabin, a trailer, etc.) containing a control workstation 197, which may be operated by a human wellsite operator 195 to monitor and control various wellsite equipment or portions of the well construction system 100. The control workstation 197 may comprise or be communicatively connected with a processing device 192 (e.g., a controller, a computer, etc.), such as may be operable to receive, process, and output information to monitor operations of and provide control to one or more portions of the well construction system 100. For example, the processing device 192 may be communicatively connected with the various surface and downhole equipment described herein, and may be operable to receive signals from and transmit signals to such equipment to perform various operations described herein. The processing device 192 may store executable program code, instructions, and/or operational parameters or set-points, including for implementing one or more aspects of methods and operations described herein. The processing device 192 may be located within and/or outside of the facility 191.

The control workstation 197 may be operable for entering or otherwise communicating control commands to the processing device 192 by the wellsite operator 195, and for displaying or otherwise communicating information from the processing device 192 to the wellsite operator 195. The control workstation 197 may comprise a plurality of human-machine interface (HMI) devices, including one or more input devices 194 (e.g., a keyboard, a mouse, a joystick, a touchscreen, etc.) and one or more output devices 196 (e.g., a video monitor, a touchscreen, a printer, audio speakers, etc.). Communication between the processing device 192, the input and output devices 194, 196, and the various wellsite equipment may be via wired and/or wireless communication means. However, for clarity and ease of understanding, such communication means are not depicted, and a person having ordinary skill in the art will appreciate that such communication means are within the scope of the present disclosure.

Well construction systems within the scope of the present disclosure may include more or fewer components than as described above and depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100, and are within the scope of the present disclosure.

Figure 2:
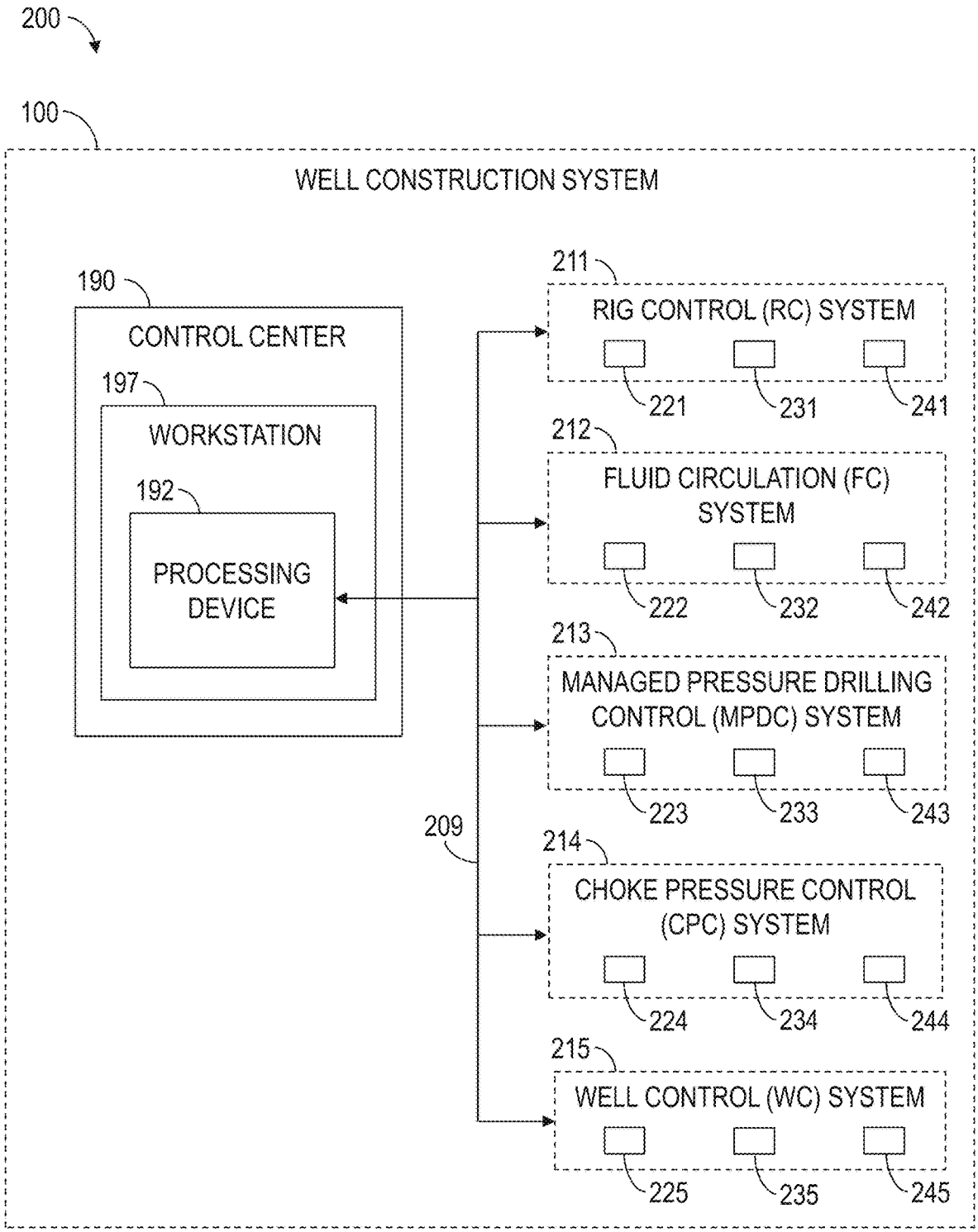
FIG. 2 is a schematic view of at least a portion of an example implementation of apparatus according to one or more aspects of the present disclosure.

The present disclosure further provides various embodiments of systems and/or methods for controlling one or more portions of the well construction system 100. FIG. 2 is a schematic view of at least a portion of an example implementation of a control system 200 for controlling the well construction system 100 according to one or more aspects of the present disclosure. The following description refers to FIGS. 1 and 2, collectively.

The control system 200 may be utilized to monitor and control various portions, components, and equipment of the well construction system 100 described herein, which may be grouped into several subsystems, each operable to perform a corresponding operation and/or a portion of the well construction operations described herein. The subsystems may include a rig control (RC) system 211, a fluid circulation (FC) system 212, a managed pressure drilling control (MPDC) system 213, a choke pressure control (CPC) system 214, and a well pressure control (WC) system 215. The control workstation 197 may be utilized to monitor, configure, control, and/or otherwise operate one or more of the subsystems 211-215.

The RC system 211 may include the support structure 112, the drill string hoisting system or equipment (e.g., the draw works 119 and the top drive 116), drill string drivers (e.g., the top drive 116 and/or the rotary table and kelly), the reciprocating slip 161, the drill pipe handling system or equipment (e.g., the catwalk 131, the PHM 163, the fingerboard 165, and the iron roughneck 151), electrical generators, and other equipment. Accordingly, the RC system 211 may perform power generation and drill pipe handling, hoisting, and rotation operations. The RC system 211 may also serve as a support platform for drilling equipment and staging ground for rig operations, such as connection make up and break out operations described above. The FC system 212 may include the drilling fluid 140, the pumps 144, drilling fluid loading equipment, the drilling fluid reconditioning equipment 170, the flare stack 177, and/or other fluid control equipment. Accordingly, the FC system 212 may perform fluid operations of the well construction system 100. The MPDC system 213 may include the RCD 138, the choke manifold 162, downhole pressure sensors 186, and/or other equipment. The CPC system 214 may comprise the choke manifold 173, and/or other equipment, and the WC system 215 may comprise the BOP equipment 130, 132, 138, the BOP control unit 137, and a BOP control station (not shown) for controlling the BOP control unit 137 and the BOP equipment 130, 132, 138. Although the wellsite equipment listed above and shown in FIG. 1 is associated with certain wellsite subsystems 211-215, such associations are merely examples that are not intended to limit or prevent such wellsite equipment from being associated with two or more wellsite subsystems 211-215 and/or different wellsite subsystems 211-215.

The control system 200 may be in real-time communication with the various components of the well construction system 100. The control system 200 may also include various local controllers 221-225 associated with corresponding subsystems 211-215 and/or individual pieces of equipment of the well construction system 100. As described above, each subsystem 211-215 of the well construction system 100 includes various wellsite equipment comprising corresponding actuators 241-245 for performing operations of the well construction system 100. Each subsystem 211-215 further includes various sensors 231-235 for monitoring operational status of the wellsite equipment.

The processing device 192 may be communicatively connected with the various local controllers 221-225, sensors 231-235, and actuators 241-245. For example, the local controllers may be in communication with the various sensors 231-235 and actuators 241-245 of the corresponding subsystems 211-215 via local communication networks (e.g., field buses, not shown) and the processing device 192 may be in communication with the subsystems 211-215 via a communication network 209 (e.g., data bus, a wide-area-network (WAN), a local-area-network (LAN), etc.). Sensor data (e.g., signals, information, etc.) generated by the sensors 231-235 of the subsystems 211-215 may be made available for use by processing device 192 and/or the local controllers 221-225. Similarly, control commands (e.g., signals, information) generated by the processing device 192 and/or the local controllers 221-225 may be automatically communicated to the various actuators 241-245 of the subsystems 211-215, perhaps pursuant to predetermined programming, such as to facilitate well construction operations and/or other operations described herein.

The sensors 231-235 and actuators 241-245 may be monitored and/or controlled by the processing device 192. For example, the processing device 192 may be operable to receive sensor measurement data from the sensors 231-235 of the wellsite subsystems 211-215 in real-time, and to provide real-time control commands to the actuators 241-245 of the subsystems 211-215 based on the received sensor data. However, certain operations of the actuators 241-245 may be controlled by the local controllers 221-225, which may control the actuators 241-245 based on sensor data received from the sensors 231-235 and/or based on control commands received from the processing device 192.

The processing device 192, the local controllers 221-225, and other controllers or processing devices operable to receive program code instructions and/or sensor data from sensors (e.g., sensors 231-235), process such information, and/or generate control commands to operate controllable equipment (e.g., actuators 241-245) may individually or collectively be referred to hereinafter as equipment controllers. Equipment controllers within the scope of the present disclosure can include, for example, programmable logic controllers (PLCs), industrial computers (IPCs), personal computers (PCs), soft PLCs, variable frequency drives (VFDs) and/or other controllers or processing devices operable to receive sensor data and/or control commands and cause operation of controllable equipment based on such sensor data and/or control commands.

Figure 3:
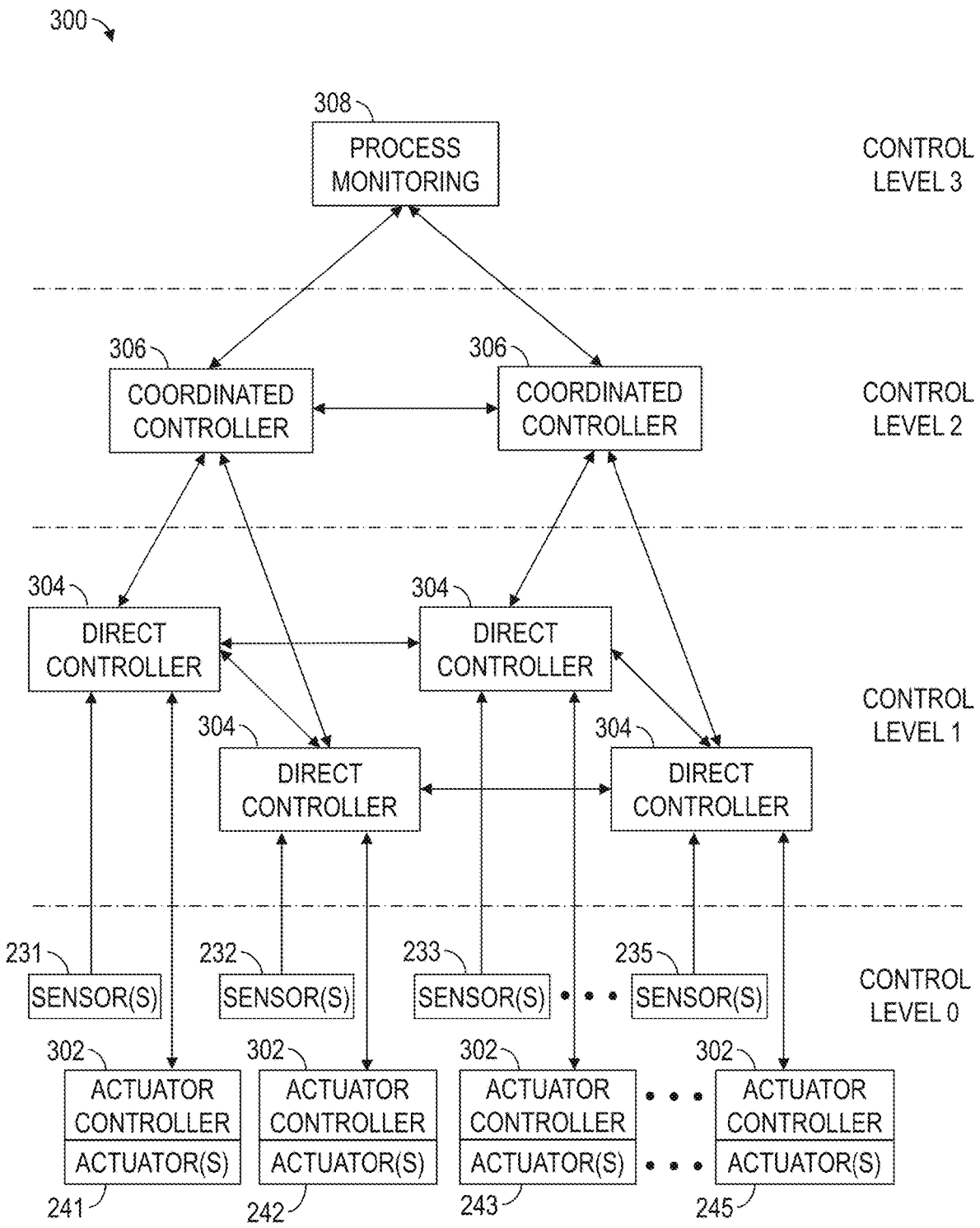
FIG. 3 is a schematic view of at least a portion of an example implementation of apparatus according to one or more aspects of the present disclosure.

FIG. 3 is a schematic view of at least a portion of an example implementation of a control system 300 for controlling a well construction system, such as the well construction system 100 shown in FIGS. 1 and 2, according to one or more aspects of the present disclosure. The control system 300 is shown divided into several control levels (i.e., tiers), namely, control level 0 (field control tier), control level 1 (PLC or bottom control tier), control level 2 (software or middle control tier), and control level 3 (supervisory or top control tier), each comprising corresponding one or more equipment controllers. The control system 300 comprises one or more features and/or modes of operation of the control system 200 shown in FIG. 2, including where identified by the same numerals. Accordingly, the following description refers to FIGS. 1-3, collectively.

Each control level of the control system 300 is associated with different hierarchy of control and comprises different equipment controllers. The equipment controllers at each control level comprise different means of installing, programming, saving, or otherwise imparting program code instructions (e.g., software, firmware, computer programs, algorithms, etc.) and different means of configuring and/or editing of the program code instructions after being imparted on the equipment controllers. A further distinction between the control levels is the speed of communications between the equipment controllers of each control level and between the equipment controllers within each control level.

Control level 0 equipment may include sensors the 231-235 and actuators 241-245 of the well construction system subsystems 211-215. Example subsystems may include the FC system 212 (which may include mud pumps, valves, fluid reconditioning equipment, etc.), the RC system 211 (which may include hoisting equipment, drill string driver (such as a top drive and/or rotary table), a PHM, a catwalk, etc.), the MPDC system 213, a cementing system, and a rig walk system, among other examples. Control level 0 equipment controllers may comprise high speed actuator controllers 302, such as VFDs, each located in association with and operable to control a corresponding actuator 241-245. Control level 0 equipment controllers may be imparted with program code instructions by the manufacturer and such program code instructions may be less suitable for modification unless performed by the manufacturer.

Instead of or in addition to utilizing the sensors 231-235 to monitor operational status of the actuators 241-245, sensor data indicative of selected operational status of the actuators 241-245 may be generated, outputted, or otherwise provided by the actuator controllers 302 to the direct controllers 304. For example, each actuator controller 302 may generate or output a control command signal or an internally utilized signal for facilitating intended operational status of the corresponding actuator 241-245. Each actuator controller 302 may also or instead directly measure certain operational status of the corresponding actuator 241-245. Such signals and/or measurements may be communicated from the actuator controllers 302 to the corresponding direct controllers 304. The local controllers 221-225 of the control system 200 may be or comprise the actuator controllers 302 of control level 0.

Control level 1 equipment controllers may include direct controllers 304, each operable to directly control and/or communicate with a corresponding level 0 actuator controller 302. Control level 1 direct controllers 304 may include PLCs, IPCs, PCs, soft PLCs, and/or other controllers or processing devices. Each direct controller 304 may be communicatively connected with a corresponding actuator controller 302, permitting control of a corresponding one or more actuators 241-245 via the actuator controller 302. Each direct controller 304 may be operable to transmit control commands to the corresponding actuator controller 302 to control the one or more actuators 241-245 that are controlled by the actuator controller 302 and to receive sensor data from the corresponding actuator controller 302 or sensors 231-235 associated with the corresponding actuator controller 302. Level 1 direct controllers 304 may be, comprise, or be implemented by one or more equipment controllers operable in a local application environment. As described below, one or more aspects disclosed herein may permit communication between the direct controllers 302 of different subsystems 211-215 through a virtual network. Sensor data may be communicated through the virtual network and a common data bus connecting the direct controllers 304 of different subsystems 211-215. The direct controllers 304 may be imparted with program code instructions and/or edited with relative difficulty, permitting just rigid computer programming. A field bus may be utilized to established communication between the direct controllers 304 and the actuator controllers 302, and/or to establish communication between direct controllers 304 within the same well construction subsystem 211-215. A field bus within the scope of the present disclosure may utilize protocols, such as EtherCAT, ProfiNET, ProfiBus, and Modbus. The local controllers 221-225 of the control system 200 may be or comprise the direct controllers 304 of control level 1.

Control level 2 equipment controllers may include coordinated controllers 306, which may be, comprise, or be implemented by one or more processing devices of various types operable in a local application environment. The coordinated controllers 306 may be implemented in PLCs and/or PCs, such as an IPC, each of which may run in real time operations systems, and may be operable to receive information and data via a communication network, and execute program code instructions. Each coordinated controller 306 may be communicatively connected with another coordinated controller 306. Each coordinated controller 306 may be communicatively connected with one or more control level 1 direct controllers 304. Each coordinated controller 306 may be operable to receive sensor data from one or more direct controllers 304 and transmit control commands to one or more direct controllers 304. The coordinated controllers 306 may be imparted with program code instructions comprising high level programming languages, such as C, and C++, among other examples, and may be used with program code instructions running in a real time operating system (RTOS). The program code instructions imparted on the coordinated controllers 306 may be edited relatively easily. A real time communication data bus may be used for communications with and/or between the level 2 coordinated controllers 306 via communication protocols, such as TCP/IP and UDP. The processing device 192 of the control system 200 may be or comprise a direct controller 304 of control level 1.

Control level 3 may include a process monitoring device 308 that does not control, but merely monitors activity and provides information to one or more of the equipment controllers 302, 304, 306 of control levels 0, 1, and 2. The process monitoring device 308 may be or comprise an equipment controller that performs control level 3 operations.

Systems and methods (e.g., processes, operations) according to one or more aspects of the present disclosure may be used or performed in association with a well construction system, such as the well construction system 100, for constructing a wellbore to obtain hydrocarbons (e.g., oil and/or gas) from a subterranean formation. Some aspects of the present disclosure may be described in the context of drilling the wellbore in the oil and gas industry. However, some aspects of the present disclosure may be utilized in other industries and/or in association with other systems. Some aspects of the present disclosure may be or comprise systems and methods of controlling a drill string, such as the drill string 120, during drilling operations to form a wellbore, as described above. The systems and methods may include, utilize, or otherwise be implemented by hardware and/or program code instructions for controlling rotation of the drill string to prevent, mitigate, inhibit, or otherwise reduce rotational waves (e.g., torsional vibrations, oscillations) at the fundamental frequency and higher order resonant frequencies that are traveling along the drill string and the resulting stick-slip motion at the bottom and/or other locations along the drill string. Such systems and methods may be caused or otherwise facilitated by program code instructions comprising a stick-slip algorithm, which, when executed by an equipment controller, may cause or otherwise facilitate methods, processes, and/or operations described herein.

Program code instructions within the scope of the present disclosure may be, comprise, or be implemented in software, firmware, middleware, microcode, hardware description languages, or a combination thereof, which may be stored in a machine readable medium, such as a memory medium. The program code instructions may represent or otherwise implement a procedure, a function, a subprogram, a program, an algorithm, an equation, a routine, a subroutine, a module, a software package, a class, or a combination of instructions, data structures, or program statements. Portions of the program code instructions may be coupled together or with a hardware circuit by passing and/or receiving information, data, arguments, parameters, or memory contents. Information, arguments, parameters, and/or data may be passed, forwarded, or transmitted via a suitable means including memory sharing, message passing, token passing, and/or network transmission.

Program code instructions comprising a stick-slip algorithm may be entered, installed, programmed, saved, or otherwise imparted onto one or more of the equipment controllers of control systems 200, 300, and/or other control systems described herein or otherwise within the scope of the present disclosure. For example, the program code instructions comprising the stick-slip algorithm may be imparted onto and/or executed by one or more of the processing device 192 and the local controllers 221-225 of the control system 200. The program code instructions comprising the stick-slip algorithm may be imparted onto and/or executed by one or more of the equipment controllers of the control system 300, such as the actuator controllers 302 of control level 0, the direct controllers 304 of control level 1, the coordinated controllers 306 of control level 2, and/or other discrete or virtual equipment controllers at each control level.

A stick-slip algorithm within the scope of the present disclosure may facilitate control of a driver (e.g., a top drive, a rotary table, etc.) to control rotation of a drill string and, thus, reduce rotational waves traveling along the drill sting. As described herein, rotational waves may travel in upward (i.e., uphole) and downward (i.e., downhole) directions along the drill string while the drill string is rotated within the wellbore. The upward traveling rotational waves may be reflected at the surface (e.g., by the driver) forming downward traveling rotational waves, which may cause or exacerbate rotational resonances and repetitive stick-slip motion along and/or at the bottom of the drill string. In a drill string having larger diameter drill pipe near the surface, some of the upward traveling rotational waves may be reflected before they reach the surface. The downward traveling rotational waves in the drill string may also include those initiated by the driver while the driver rotates the drill string. The downward traveling rotational waves produced by the driver are mandated to drive a drill bit through the earth formation. Thus, the downward traveling energy comprises intended downward traveling energy that is utilized to drive the drill bit and unintended (i.e., undesirable) downward traveling energy that causes vibrations and/or stick-slip motion of the drill string. The stick-slip algorithm may also permit control of rotational waves traveling along other tubular strings, such as liner and casing strings, during well completion operations.

A stick-slip algorithm within the scope of the present disclosure may cause the driver to vary rotational speed of the drill string to absorb, dampen, or otherwise reduce the upward traveling rotational waves, thereby preventing, mitigating, inhibiting, or otherwise reducing corresponding reflected downward traveling rotational waves, resonances, and other vibrations along and/or at the bottom of the drill string and the resulting stick-slip motion of the drill string. The stick-slip algorithm may be utilized to achieve and maintain an intended average (i.e., nominal) rotational speed $v_0$ of the drill string at the surface (i.e., at the driver) while reducing or minimizing the rotational speed $v_{down}$ and, thus, energy of the downward traveling rotational waves. The stick-slip algorithm may be well suited for implementation in association with an outer control system driving a fast, built-in driver control system for imparting an intended rotational speed to the drill string. Modern proportional and integral (PI) top drive controllers, combined with high power top drives, can maintain tight control over rotational speeds of the drill string. Both parameters and/or conditions intended for optimal and/or intended drilling operations and parameters and/or conditions for preventing, mitigating, inhibiting, or otherwise reducing the rotational waves and stick-slip motion can be processed, executed, or otherwise implemented during the drilling operations.

Accordingly, one or more equipment controllers of the control systems 200, 300 and other control systems described herein may be operable to execute or otherwise utilize a stick-slip algorithm to determine an intended rotational speed v of a drill string, that balances and/or optimizes delivery of downward traveling rotational energy to a drill bit while reducing the downward travelling energy that causes the unintended rotational waves and stick-slip motion. Thus, a stick-slip algorithm within the scope of the present disclosure may also be referred to as an energy optimization algorithm.

Equipment controllers according to one or more aspects of the present disclosure can form or provide an outer control system for controlling the fast, built-in actuator controllers 302 (e.g., VFDs) of the driver. Control within the scope of the present disclosure may include the outer control system determining and providing an intended drill string rotational speed v to the built-in actuator controller 302, which attempts to achieve and/or maintain an intended rotational speed $v_0$, while causing the driver to vary (e.g., speed up or slow down) rotational speed of the drill string around the intended rotational speed $v_0$ to reduce the amount of the unintended downward traveling energy within the tool string.

A stick-slip algorithm within the scope of the present disclosure may be derived and implemented via mathematical equations modeling or otherwise characterizing portions of the drilling system, such as the drill string and/or the driver. For example, contrary objectives of maximizing energy sent down the drill string to rotate the drill bit by rotating the drill string while reducing (e.g., minimizing) the unintended downward traveling energy that causes vibrations and stick-slip of the drill string may be viewed as a minimization constraint characterized by Equation (1).

$$E=(v-v_0)^2+\lambda v_{down}^2 \quad (1)$$

where E is energy, $v_0$ is an intended average (nominal) rotational speed of the drill string at the surface that is to be imparted by the driver rotating the drill string to drill the wellbore, $v_{down}$ is a rotational speed of the downward traveling rotational wave, λ (lambda) is a coefficient indicative of a relative weight given to the two conflicting objectives and may range between zero and one, and v is an intended rotational speed of the drill string at the surface that is to be imparted by the driver rotating the drill string to reduce or dampen the upward traveling waves when they reach the surface and, thus, reduce the downward traveling waves and the resulting stick-slip motion. The rotational speed v is the sum of $v_{down}$ and rotational speed $v_{up}$ of an upward traveling rotational wave. Accordingly, Equation (1) can be rewritten as Equation (2).

$$E=(v-v_0)^2+\lambda(v-v_{up})^2 \tag{2}$$

The intended rotational speed $v_0$ may be selected by a user (e.g., wellsite operator) based on various drilling parameters, such as those related to drill bit characteristics, weight-on-bit, wellbore depth, drilling fluid characteristics, and formation characteristics, among other example. The constant λ controls how much reduction in rotational resonance is to be provided by the control system. For example, when constant λ is set to zero, the control system will provide zero reduction in torsional resonance. The intended torsional resonance control may be selected base on and weighed against other drilling parameters. Equations (1) and/or (2) can be implemented in the stick-slip algorithm described herein, which may be utilized by one or more equipment controllers to calculate or otherwise determine the rotational speed v.

A control command signal or information indicative of the intended rotational speed v may be generated and communicated to the actuator controller 302, such as a top-drive motor controller, on the assumption that the actuator controller 302 is able to achieve such rotational speed v. Although modern top-drive motor controllers are normally able to achieve rotational speeds that are close to intended (i.e., commanded) speeds, small differences between the actual and intended speeds may exist. Such small differences do not invalidate the stick-slip algorithm within the scope of the present disclosure. Furthermore, although the left side of the Equations (1) and (2) are written in terms of energy and the right sides of the Equations (1) and (2) are written in terms of rotational speed, it is to be understood that energy and rotational speed are proportional to each other via a proportionality constant or multiplier (e.g., related to mass moment of inertia of the drill string), which may be applied to the right side of the Equations (1) and (2). However, for clarity and ease of understanding, such proportionality constant is not included in the Equations (1) and (2).

The rotational speed $v_{up}$ of the upward traveling rotational wave and rotational speed $v_{down}$ of the downward traveling rotational wave may be estimated based on simultaneous surface measurements (e.g., sensor data, status signals or information) indicative of rotational speed v of the drill string and torque T applied to the drill string. For example, the rotational speeds $v_{up}$ and $v_{down}$ may be calculated by utilizing Equations (3) and (4).

$$v_{up} = \frac{1}{2}\left(v - \frac{T}{z}\right) \tag{3}$$

$$v_{down} = \frac{1}{2}\left(v + \frac{T}{z}\right) \tag{4}$$

where z is rotational impedance of the drill string (i.e., drill pipes), rotational speed v is an actual measured rotational speed of the drill string at the surface, and T is a torque applied by the driver to the drill string at the surface. The rotational impedance z may be determined from drill string (i.e., drill pipe) dimensions and/or other specifications. Thus, when rotational speed v appears on a left-hand-side of an equation, such rotational speed is to be interpreted as the intended rotational speed commanded to be achieved by the driver. When the rotational speed v appears on a right-hand-side of an equation, such rotational speed is to be interpreted as the most recent actual measured rotational speed of the driver. However, if the actual measured rotational speed is not available, the most recent previous commanded rotational speed can be substituted.

Corresponding upward and downward traveling energies are proportional to $v^2_{up}$ and $v^2_{down}$, and the sum of the upward and downward traveling energies is proportional to the total rotational energy of the drill string. Such relationship can be characterized by Equation (5).

$$v_{up}^2 + v_{down}^2 = \frac{1}{2}v^2 + \frac{1}{2z^2}T^2 \tag{5}$$

Although it is optimal for a correct value of rotational impedance z to be utilized, an equipment controller executing or otherwise utilizing the stick-slip algorithm can be robust to errors in the value of rotational impedance z. Solving Equations (1) and (2), the intended rotational speed v may be determined by utilizing Equation (6).

$$v = \frac{v_0 + \lambda v_{up}}{1+\lambda} \tag{6}$$

However, this solution causes a slower intended average rotational speed $v_0$ of the drill string than is intended. Namely, the rotational speed $v_0$ reduces downward traveling energy and, thus, reduces vibration of the drill string. However, the downward traveling energy is so low that it produces a rotational speed of the drill bit that is undesirably low. Accordingly, the minimization constraint captured in Equation (1) can be rewritten as Equation (7).

$$E=(v-(1+\lambda)v_0)^2+\lambda v_{down}{}^2 \tag{7}$$

Optimal intended rotational speed v may be determined by taking a derivative of the minimization constraint Equation (7) with respect to the rotational speed v, setting the result equal to zero, and solving for the rotational speed v, thereby resulting in Equation (8).

$$v = v_0 + \frac{\lambda}{1+\lambda}v_{up} \tag{8}$$

The rotational speed $v_{up}$ of the upward traveling rotational wave on the right hand side of Equation (8) may be calculated from the most recent measurements of torque T and rotational speed v, resulting in a slight lag.

A residual correction integral term r may be included in Equation (8) to account for the long term average of the intended rotational speed v. The residual correction term results in the minimization constraint captured in Equation (9).

$$v(t) = r(t) + v_0(t) + \frac{\lambda}{1+\lambda}v_{up}(t-\delta) \tag{9}$$

where t is the current time and δ is a sampling time interval. Accordingly, Equation (9) may be utilized to calculate or otherwise determine the intended (i.e., commanded) rotational speed v by inputting into Equation (9) the rotational speed $v_{up}$ of the upward traveling wave, the intended average rotational speed $v_0$, and the coefficient λ. The value of coefficient A may be one. The rotational speed $v_{up}$ may be estimated via Equation (3) using current measurements of torque T and rotational speed v.

Rate of change of the residual correction r may be proportional to the difference between the current measured rotational speed v and the intended average rotational speed $v_0$, as indicated in Equation (10).

$$\frac{dr}{dt} = \frac{1}{k}(v - v_0) \tag{10}$$

where k is a filter parameter chosen such that it is long compared to the resonance time of the drilling system. For example, k may be of the order of 60 seconds or longer. Optionally, it is possible to independently control measurements (i.e., sensor data) indicative of torque T versus measurements indicative of rotational speed v by modifying equation (9) to provide a more general Equation (11).

$$v(t) = v_0(t) + r(t) + k_1 v - k_2 \frac{T}{z} \tag{11}$$

In discrete time, with sampling time interval δ, the residual correction integral term r may be calculated via equation (12).

$$r_j = r_{j-1} + \frac{\delta}{k}(v_j - v_{0(j)}) \tag{12}$$

A high-pass filter may be applied to measurements indicative of rotational speed $v_{up}$ utilized in Equation (9). A low-pass filter may also or instead be applied using a one-pole low-pass filter with the same value of the filter parameter k. Low and/or high-pass filtering may thus be applied to signals indicative of the rotational speed $v_{up}$ as indicated by Equations (13) and (14), respectively.

$$v^l_{up_j} = \left(1 - \frac{\delta}{k}\right)v^l_{up_{j-1}} + \frac{\delta}{k}v_{up_j} \tag{13}$$

$$v^h_{up_j} = v_{up_j} - v^l_{up_j} \tag{14}$$

where the subscript j indicates a time step, the superscript l indicates a filtered-out low-pass signal, and the superscript h indicates a remaining high-pass signal.

To avoid sending high-frequency noise to the drive system (e.g., the driver controller or the like) that may interact with the operation of the stick-slip algorithm, an estimate of the rotational speed $v_{up}$ of the upward traveling rotational wave may be low-pass filtered. This can be done in the same manner as for the residual correction term r, however with a smaller value of the filter parameter k, which may be selected such that it does not filter out the main rotational resonance of the drill string. The value of the filter parameter k may be, for example, on the order of 0.1 seconds. A low-pass one-pole filter may be provided according to Equation (15).

$$v^f_{up_j} = \left(1 - \frac{\delta}{k}\right)v^f_{up_{j-1}} + \frac{\delta}{k}v_{up_j} \tag{15}$$

where the superscript f indicates a filtered signal indicative of rotational speed $v_{up}$ of the upward traveling rotational wave.

During drilling operations, if the drill bit sticks hard, it is possible for the drill string to completely stop rotating. To avoid this scenario, a minimum value of intended rotational speed v may be imposed. For example, a minimum value of rotational speed v that is 25% to 50% less than the intended average rotational speed $v_0$ may be imposed on the driver. Similarly, a maximum value of rotational speed v may be imposed on the driver, such as to reduce vibrations imparted to a supporting structure (e.g., rig). Thus, Equation (9) may be rewritten as Equation (16).

$$v_j = r_j + v_{0_j} + \frac{\lambda}{1+\lambda}v^f_{up_{j-1}} \tag{16}$$

A stick-slip algorithm within the scope of the present disclosure, such as implemented by one or more of the Equations (1) through (16) (e.g., Equation (8), (9), (11), or (16)), may be contained within or captured by program code instructions, which may be executed or otherwise processed by an equipment controller of a control system disclosed herein or otherwise within the scope of the present disclosure to output control commands (signals) indicative of intended rotational speed v of the drill string. For example, the program code instructions comprising the stick-slip algorithm may be executed or otherwise processed by one or more of the equipment controllers 192, 221-225 of the control system 200 shown in FIG. 2 and the equipment controllers 302, 304, 306 of the control system 300 shown in FIG. 3. However, other control systems disclosed herein or otherwise within the scope of the present disclosure may also or instead implement the stick-slip algorithm. Furthermore, it is to be understood that the stick-slip algorithm implemented by one or more of the Equations (1) through (16) is merely an example algorithm. Therefore, it is to be further understood that the control systems within the scope of the present disclosure may utilize or otherwise implement program code instructions comprising other algorithms (i.e., implemented by other equations) for controlling rotational speed of a drill string to reduce rotational waves (e.g., torsional vibrations, oscillations, and/or resonances) traveling along the drill string and reduce stick-slip motion of the drill string. It is to be also understood that a stick-slip algorithm within the scope of the present disclosure may be combined with or work in association with one or more other algorithms to control rotational speed of a drill string.

Figure 4:
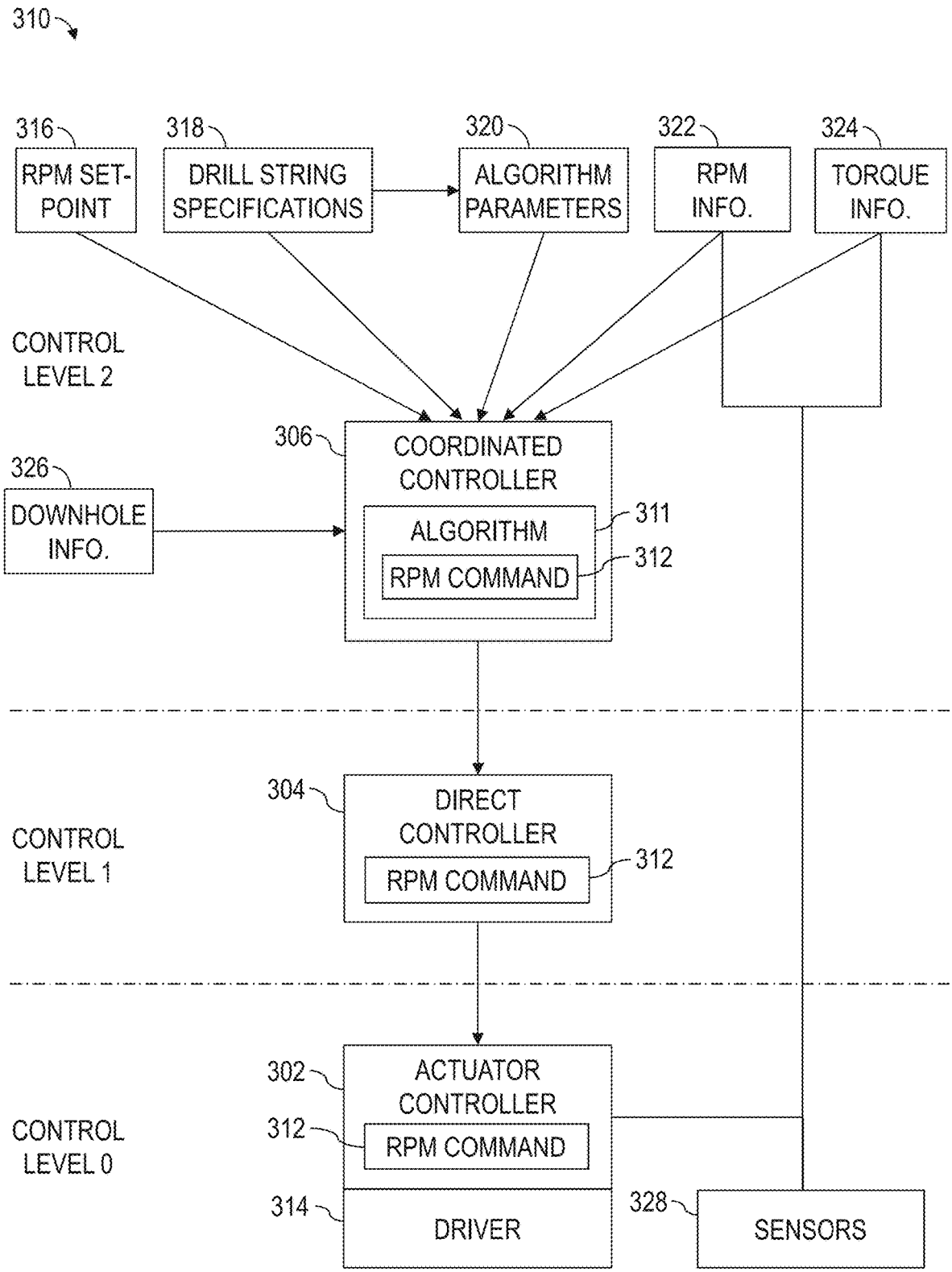
FIG. 4 is a schematic view of at least a portion of an example implementation of apparatus according to one or more aspects of the present disclosure.

FIG. 4 is a schematic view of at least a portion of an example implementation of a control system 310 according to one or more aspects of the present disclosure that may implement a stick-slip algorithm to control rotational speed of a drill string of a well construction system, such as the well construction system 100 shown in FIG. 1. The control system 310 is shown divided into several control levels, namely, level 0, level 1, and level 2, each comprising corresponding one or more equipment controllers. The control system 310 comprises one or more features and/or modes of operation of the control systems 200, 300 shown in FIGS. 2 and 3, respectively, including where identified by the same numerals. Accordingly, the following description refers to FIGS. 1-4, collectively.

The control system 310 includes program code instructions, comprising a stick-slip algorithm 311, entered, installed, programmed, saved, or otherwise imparted on and/or executed by a coordinated controller 306 (e.g., a software equipment controller, such as a PC or IPC) of control level 2. The stick-slip algorithm 311 may be implemented by one or more of the Equations (1) through (16) or other equation(s) that may be utilized to compute, output, or otherwise determine an intended rotational speed control signal or command 312 for controlling rotational speed (e.g., revolutions per minute (RPM)) of an actuator (e.g., a motor) of a driver 314 (e.g., a top drive or rotary table) and thus, rotational speed of a drill string. Prior to and/or during drilling operations, the coordinated controller 306 may receive various information and execute the stick-slip algorithm 311 based on the received information to determine the intended rotational speed command 312, which may be referred to as an RPM command 312. The RPM command 312 may be or comprise a signal or information indicative of the intended rotational speed of the drill string, such as the intended rotational speed v described above in association with one or more of the Equations (1) through (16).

The coordinated controller 306 may receive one or more input parameters to configure (i.e., complete) the stick-slip algorithm 311. The input parameters may be, comprise, or indicate physical (e.g., mechanical, material, etc.) properties or characteristics of the drill pipes or drill string and/or numerical parameters (e.g., numerical terms, coefficients, constants, and variables, etc.) of the stick-slip algorithm 311. For example, the coordinated controller 306 may receive an intended average (nominal) rotational speed of the driver 314 to control the rotational speed of the drill string at the surface. The intended average rotational speed may be referred to as an RPM set-point 316, and may be or comprise the intended average rotational speed $v_0$ described above in association with one or more of the Equations (1) through (16). The coordinated controller 306 may receive specifications 318 of the drill string, such as may include, for example, drill string length, drill string mass, drill pipe dimensions, drill pipe quantity, and/or drill pipe material. The coordinated controller 306 may receive one or more parameters 320 of the stick-slip algorithm 311, such as the numerical parameters described above in association with one or more of the Equations (1) through (16). For example, the coordinated controller 306 may receive one or more of the rotational speed $v_{up}$ of an upward traveling rotational wave, a value of the residual correction term r, a value of the filter parameter k for r(t) term evolution, a value of the constant A, minimum and/or maximum values of the intended rotational speed v, rotational impedance z of the drill string, and low and/or high pass filter parameters for filtering upward traveling rotational waves.

Certain parameters 320 may be determined based on the drill string specifications 318 and then transmitted to the coordinated controller 306. For example, the rotational impedance z may be determined prior to being transmitted to the coordinated controller 306 based on certain drill string specifications 318, and then transmitted to the coordinated controller 306. The rotational speed $v_{up}$ of an upward traveling rotational wave may be determined prior to being transmitted to the coordinated controller 306, for example, based on Equation (3) and drill string specifications 318, such as rotational impedance z and initial torque T and rotational speed v settings or measurements, and then transmitted to the coordinated controller 306. However, the rotational impedance z and/or rotational speed $v_{up}$ of the upward traveling rotational wave may be determined by the coordinated controller 306, for example, based on the drill string specifications 318 received by the coordinated controller 306 and/or Equation (3) listed above. The input parameters 316, 318, 320 may be entered into the coordinated controller 306 by a human wellsite operator via an HMI, such as a keyboard, communicatively connected with the coordinated controller 306.

When the algorithm is configured (i.e., completed) with the input parameters 316, 318, 320, the coordinated controller 306 may execute the stick-slip algorithm 311 based on the input parameters 316, 318, 320 to generate or output an initial RPM command 312. The determined RPM command 312 may then be communicated to a direct controller 304 (e.g., a PLC) at control level 1. The rotational speed command 312 may then be communicated to an actuator controller 302 (e.g., a VFD) associated with an actuator of the driver 314 at control lever 0, thereby causing the driver 314 to rotate the drill string at the intended rotational speed indicated by the RPM command 312 to commence the drilling operations. The coordinated controller 306 may then receive operational status signals or information (i.e., measurements) indicative of operational status of the drill string, such as rotational speed (RPM) information 322 indicative of rotational speed of the drill string at the driver, and torque information 324 indicative of torque applied to the drill string by the driver. The operational status information 322, 324 may be or comprise feedback signals or information generated by one or more pieces of equipment disposed in association with the driver 314 and/or the drill string. The coordinated controller 306 may then determine or update the RPM command 312 via the stick-slip algorithm 311 based on the RPM and torque status information 322, 324. The determined RPM command 312 may then be communicated to the direct controller 304 at control level 1. The rotational speed command 312 may then be communicated to the actuator controller 302 associated with the actuator of the driver 314 at control lever 0 to cause the driver 314 to rotate the drill string at the intended rotational speed indicated by the updated RPM command 312. The direct controller 304 may continually receive the operational status information 322, 324, execute the algorithm 311 based on the latest operational status information 322, 324 to determine an updated RPM command 312, and transmit the updated RPM command 312 to the actuator controller 302 to control the rotational speed of the drill string.

The RPM and torque status information 322, 324 may be generated, outputted, or otherwise provided by one or more sensors 328 located in association with the driver 314 and/or the drill string, and transmitted or otherwise inputted to the coordinated controller 306. For example, the RPM status information 322 may be generated by a rotational speed sensor, which may be or comprise an encoder, a rotary potentiometer, a synchro, a resolver, a proximity sensor, a Hall effect sensor, and/or a rotary variable-differential transformer (RVDT), among other examples. The torque status information 324 may be generated by a torque sensor, which may be or comprise a load cell, and/or a torque sub, among other examples.

Instead of or in addition to utilizing the sensors 328, the RPM and torque status information 322, 324 may be generated, outputted, or otherwise provided by the actuator controller 302 and transmitted or otherwise inputted to the coordinated controller 306. The RPM and/or torque status information 322, 324 may be based on amount of electrical current provided by the actuator controller 302 (e.g., VFD)

to the actuator (e.g., a motor) of the driver 314. The actuator controller 302 may generate, output, or utilize control signals indicative of intended rotational speed and/or torque of the drill string. The actuator controller 302 may also or instead generate, output, or utilize measurement signals indicative of actual rotational speed of and/or torque applied to the drill string. Such control signals and/or measurement signals may be utilized as the RPM and torque status information 322, 324 and may be communicated from the actuator controller 302 and inputted into the coordinated controller 306.

One or more portions of the control system 310 may also receive downhole status information 326 experienced by one or more downhole portions (e.g., drill pipe, a BHA, a drill bit, etc.) of the drill string from sensors located in association with the one or more downhole portions of the drill string during drilling operations. The downhole status information 326 may include operational information of the drill string downhole, such as, rotational speed of the drill string downhole, torque applied to the drill string downhole, frequency and/or amplitude of rotational, lateral, and/or axial vibrations downhole, magnitude of rotational speed fluctuations downhole, frequency (or period) of the rotational speed fluctuations downhole, and information indicative of amount of energy present at each of the drill string scale torsional resonances (e.g., fundamental, second, third, etc.) downhole. The downhole status information 326 may be communicated from downhole sensors (e.g., sensors 186 shown in FIG. 1) of a drill string and communicated to the surface equipment via downhole telemetry. Such downhole sensors may include one or more of an encoder, a rotary potentiometer, a synchro, a resolver, a proximity sensor, a Hall effect sensor, an RVDT, an accelerometer, and a torque sensor, which may be or comprise a load cell and/or a torque sub, among other examples. The downhole status information 326 may be received by the coordinated controller 306 at control level 2. The coordinated controller 306 may then determine the RPM command 312 via the stick-slip algorithm 311 based on the received information 316, 318, 320, 322, 324, 326.

During drilling operations, the coordinated controller 306 may be operable to generate the RPM command 312 at least partially based on the downhole information 326 indicative of operational status (e.g., magnitude of stick-slip action, lateral vibrations, axial vibrations, rotational waves, etc.) of the drill string downhole. The generated RPM command 312 may cause the driver 314 to rotate the drill string at a substantially constant rotational speed, such as by disengaging the stick-slip control action, when the downhole information 326 is indicative that no stick-slip action is occurring and/or no rotational waves are traveling along the drill string. The generated RPM command 312 may cause the driver 314 to vary the rotational speed of the drill string to reduce the rotational waves traveling along the drill string when the downhole information 326 is indicative that stick-slip action is occurring and/or rotational waves are traveling along the drill string.

During drilling operations, such as when the downhole information 326 is indicative that the stick-slip action and/or rotational waves traveling along the drill string are not being reduced, the program code instructions may cause the coordinated controller 306 to automatically change one or more of the algorithm parameters 320 (e.g., numerical parameters) of the stick-slip algorithm 311 based on the downhole information 326. The changed algorithm parameters 320 may cause the RPM command 312 being generated by the coordinated controller 306 to change, causing the driver 314 to vary rotational speed of the drill string based on the changed RPM command 312. The algorithm parameters 320 may be automatically changed at least until the downhole information 326 indicates that the stick-slip action and/or rotational waves traveling along the drill string are eliminated or reduced below a predetermined level.

The RPM set-point 316 and the algorithm parameters 320 may be or comprise low frequency information, such as changing every few seconds or minutes. The RPM status information 322, the torque status information 324, and the RPM command 312 may be or comprise higher frequency information, such as changing at frequencies ranging, for example, between about 10 and 200 hertz (Hz) or more. As described herein and shown in FIG. 4, the RPM command 312 may be determined by and transmitted from the coordinated controller 306 at control level 2 to the direct controller 304 at control level 1. The RPM command 312 may include PI gain values to be used in a PI rotational speed control. Control of the rotational speed of the driver 314 may be in response to rotational waves traveling upward along the drill string. Thus, the RPM command 312 may be indicative of actual rotational speeds that are greater than or lesser than the intended rotational speeds of the driver 314.

Figure 5:
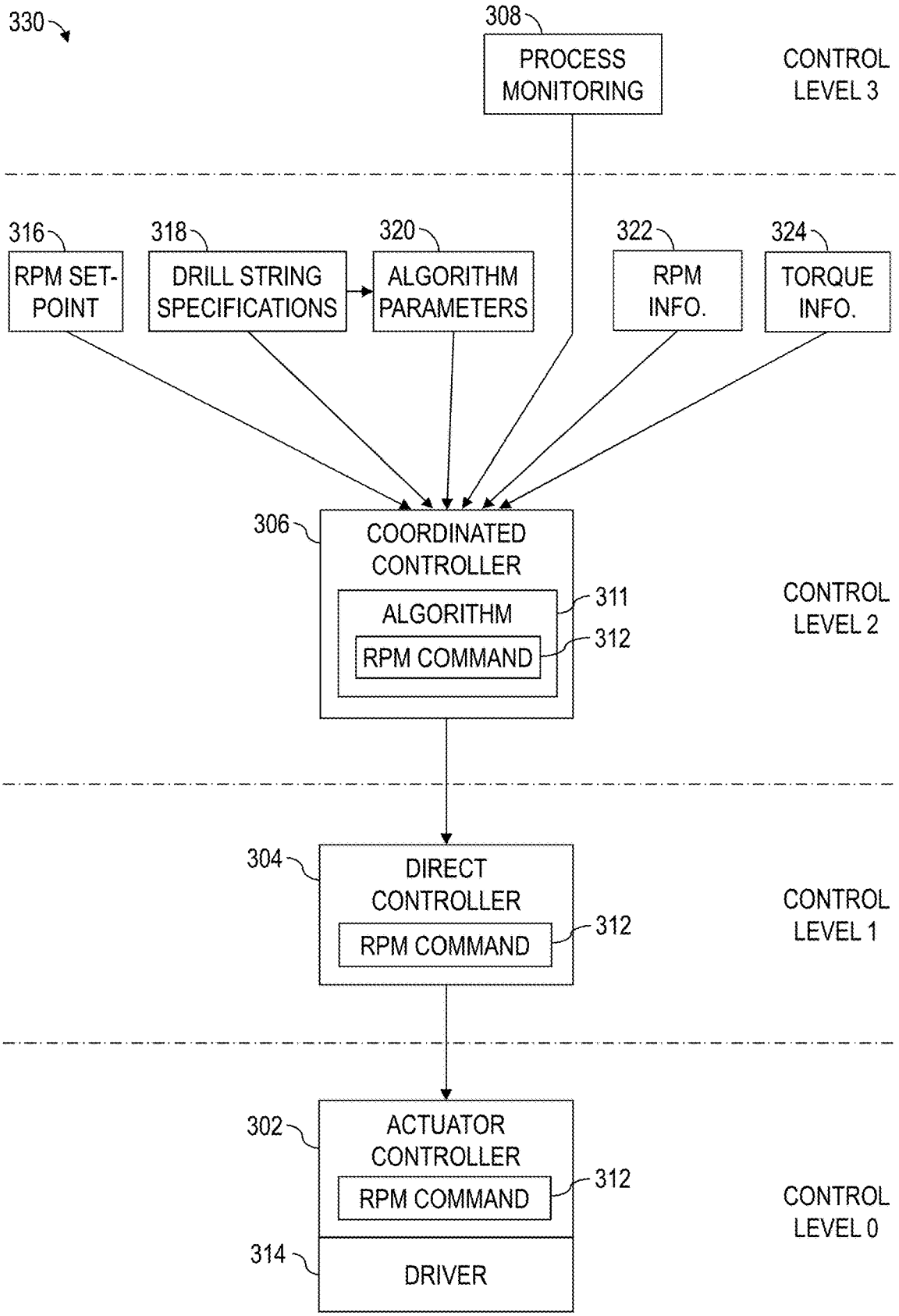
FIG. 5 is a schematic view of at least a portion of an example implementation of apparatus according to one or more aspects of the present disclosure.

FIG. 5 is a schematic view of at least a portion of an example implementation of a control system 330 according to one or more aspects of the present disclosure that may implement a stick-slip algorithm to control rotational speed of a drill string of a well construction system, such as the well construction system 100 shown in FIG. 1. The control system 330 is shown divided into control levels 0, 1, 2, and 3, each comprising corresponding one or more equipment controllers. The control system 330 comprises one or more features and/or modes of operation of the control systems 200, 300, 310 shown in FIGS. 2-4, respectively, including where identified by the same numerals. Accordingly, the following description refers to FIGS. 1-5, collectively.

The control system 330 includes program code instructions, comprising a stick-slip algorithm 311, imparted on and executed by a coordinated controller 306 of control level 2 to determine an RPM command 312 for controlling rotational speed of a driver 314 for driving or actuating a top drive or rotary table and, thus, controlling rotational speed of the drill string. The control system 330 may further comprise a process monitoring device 308 at control lever 3 communicatively connected with the coordinated controller 306. The process monitoring device 308 may facilitate job-type data to be communicated to the coordinated controller 306. For example, the process monitoring device 308 may be or comprise a job planner or another operations monitoring device for collecting operational data, such as information from offset wells, job planning or operational sequence data for an ongoing job, drilling status information, and drilling equipment information, including information indicative of operational status of the drill string, the BHA, and/or other equipment.

Figure 6:
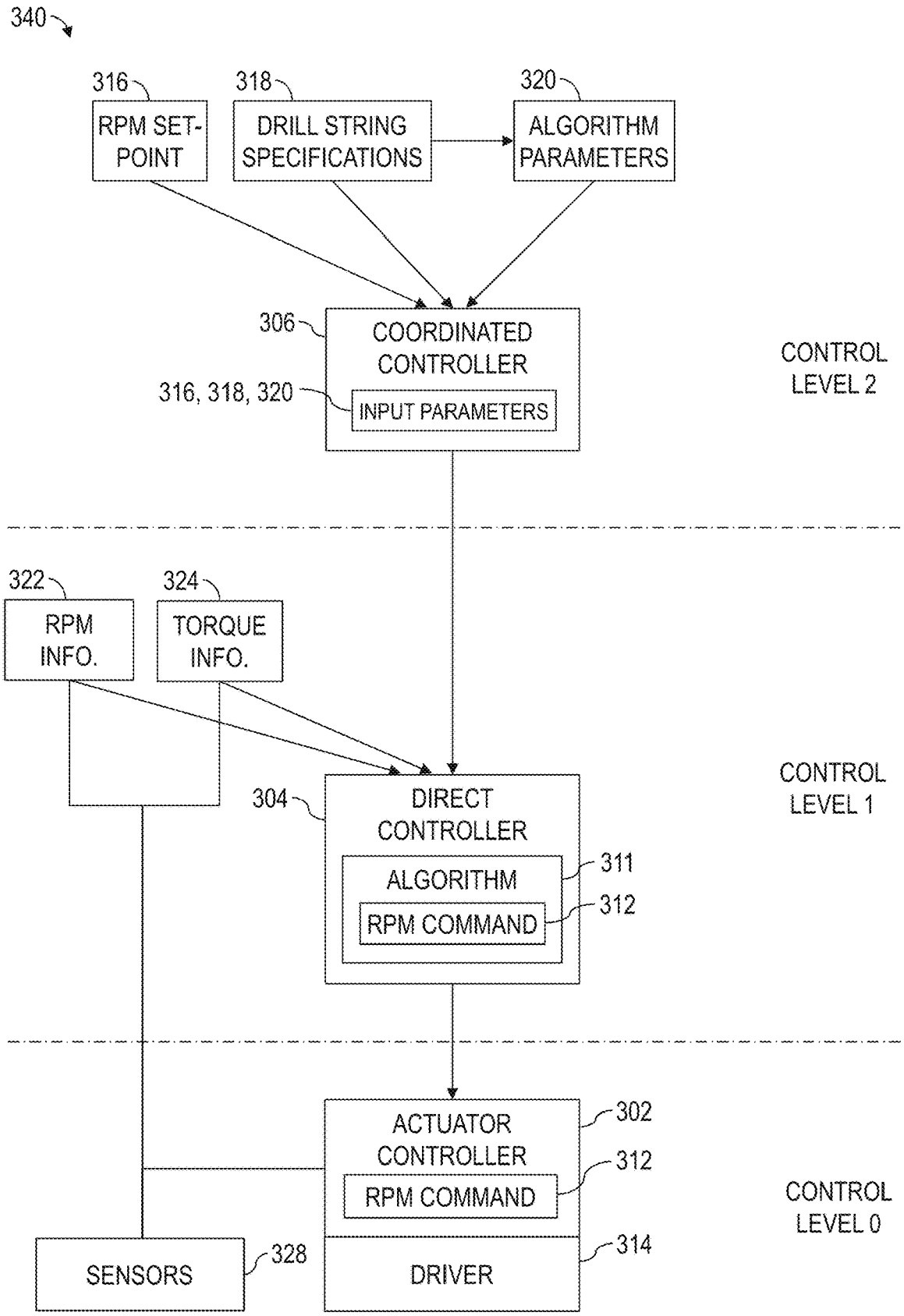
FIG. 6 is a schematic view of at least a portion of an example implementation of apparatus according to one or more aspects of the present disclosure.

FIG. 6 is a schematic view of at least a portion of an example implementation of a control system 340 according to one or more aspects of the present disclosure that may implement a stick-slip algorithm to control rotational speed of a drill string of a well construction system, such as the well construction system 100 shown in FIG. 1. The control system 340 is shown divided into control levels 0, 1, and 2, each comprising corresponding one or more equipment controllers. The control system 340 comprises one or more features and/or modes of operation of the control systems 200, 300, 310, 330 shown in FIGS. 2-5, respectively, including where identified by the same numerals. Accordingly, the following description refers to FIGS. 1-6, collectively.

The control system 340 includes program code instructions, comprising a stick-slip algorithm 311 imparted on and/or executed by a direct controller 304 of control level 1 to determine an RPM command 312 for controlling rotational speed of a driver 314 and thus, rotational speed of the drill string. Input parameters, such as an RPM set-point 316, drill string specifications 318, and algorithm parameters 320, may be entered into a coordinated controller 306 at control level 2 and transmitted to the direct controller 304 to configure the stick-slip algorithm 311. The configured stick-slip algorithm 311 may then be executed by the coordinated controller 306 to generate the RPM command 312. The RPM command 312 may then be communicated to a control lever 0 actuator controller 302 associated with an actuator of the driver 314 to cause the driver 314 rotate the drill string at an intended rotational speed indicated by the RPM command 312. Actual RPM status information 322 and actual torque status information 324 may be received or recorded by the direct controller 304, which may then determine or update the RPM command 312 via the stick-slip algorithm 311 based on the RPM and torque status information 322, 324. The updated RPM command 312 may then be communicated to the actuator controller 302 associated with the actuator of the driver 314 to cause the driver 314 rotate the drill string at an intended rotational speed indicated by the RPM command 312. The direct controller 304 may continually receive the operational status information 322, 324, 326, execute the algorithm 311 based on the latest operational status information 322, 324, 326 to determine an updated RPM command 312, and transmit the updated RPM command 312 to the actuator controller 302 to control the rotation of the drill string.

The RPM and torque status information 322, 324 may be generated, outputted, or otherwise provided by one or more sensors 328 located in association with the driver 314 and/or the drill string, and transmitted or otherwise inputted to the direct controller 304. Instead of or in addition to utilizing the sensors 328, internal actuator controller 302 control and/or measurement signals indicative of intended and/or actual rotational speed and/or torque of the driver 314, may be utilized as the RPM and torque status information 322, 324 by the direct controller 304 to generate or update the RPM command 312.

During drilling operations, the direct controller 304 may be operable to generate the RPM command 312 at least partially based on the downhole information 326 indicative of operational status (e.g., magnitude of stick-slip action, lateral vibrations, axial vibrations, rotational waves, etc.) of the drill string downhole. The generated RPM command 312 may cause the driver 314 to rotate the drill string at a substantially constant rotational speed, such as by disengaging the stick-slip control action, when the downhole information 326 is indicative that no stick-slip action is occurring and/or no rotational waves are traveling along the drill string. The generated RPM command 312 may cause the driver 314 to vary the rotational speed of the drill string to reduce the rotational waves traveling along the drill string when the downhole information 326 is indicative that stick-slip action is occurring and/or rotational waves are traveling along the drill string.

During drilling operations, such as when the downhole information 326 is indicative that the stick-slip action and/or rotational waves traveling along the drill string are not being reduced, the program code instructions may cause the direct controller 304 or coordinated controller 306 to automatically change one or more of the algorithm parameters 320 (e.g., numerical parameters) of the stick-slip algorithm 311 based on the downhole information 326. The changed algorithm parameters 320 may cause the RPM command 312 being generated by the direct controller 304 to change, causing the driver 314 to vary rotational speed of the drill string based on the changed RPM command 312. The algorithm parameters 320 may be automatically changed at least until the downhole information 326 indicates that the stick-slip action and/or rotational waves traveling along the drill string are eliminated or reduced below a predetermined level.

The RPM set-point 316 and the algorithm parameters 320 may be or comprise low frequency information, and the RPM status information 322, the torque status information 324, and the RPM command 312 may be or comprise higher frequency information. The RPM status information 322 and the torque status information 324 may be recorded by the direct controller 304 at control level 1. Similarly to the control system 330 shown in FIG. 5, the control system 340 may further comprise a process monitoring device 308 at control lever 3 communicatively connected with the coordinated controller 306. The process monitoring device 308 may facilitate job-type data to be communicated to the coordinated controller 306.

Figure 7:
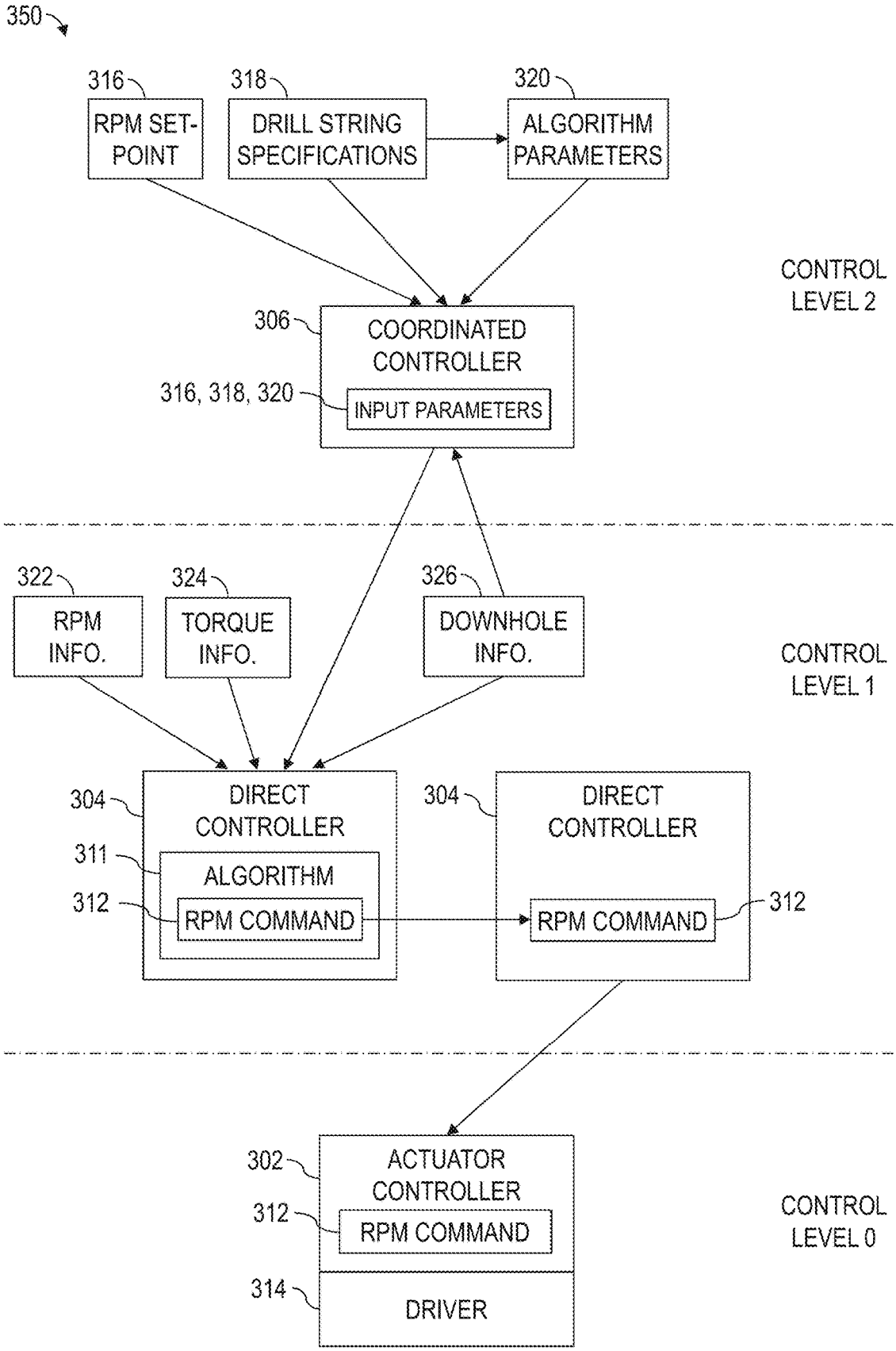
FIG. 7 is a schematic view of at least a portion of an example implementation of apparatus according to one or more aspects of the present disclosure.

FIG. 7 is a schematic view of at least a portion of an example implementation of a control system 350 according to one or more aspects of the present disclosure that may implement a stick-slip algorithm to control rotational speed of a drill string of a well construction system, such as the well construction system 100 shown in FIG. 1. The control system 350 is shown divided into control levels 0, 1, and 2, each comprising corresponding one or more equipment controllers. The control system 350 comprises one or more features and/or modes of operation of the control systems 200, 300, 310, 330, 340 shown in FIGS. 2-6, respectively, including where identified by the same numerals. Accordingly, the following description refers to FIGS. 1-7, collectively.

The control system 350 includes program code instructions, comprising a stick-slip algorithm 311, imparted on and/or executed by a direct controller 304 of control level 1 to determine an RPM command 312 for controlling rotational speed of an actuator of a driver 314 and thus, rotational speed of the drill string. However, the direct controller 304 comprising the stick-slip algorithm 311 may not be directly communicatively connected or associated with the driver 314 intended to be controlled. As described above, the input parameters 316, 318, 320 may be entered into and/or received by a coordinated controller 306 at control lever 2. The input parameters 316, 318, 320 may then be communicated from the coordinated controller 306 to the direct controller 304 comprising the stick-slip algorithm 311. The direct controller 304 may then determine the RPM command 312 via the configured stick-slip algorithm 311 based on the input parameters 316, 318, 320. The RPM command 312 may then be communicated to another direct controller 304 that is associated with the driver 314. The RPM command 312 may then be transmitted to an actuator controller 302 associated with the driver 314 to cause the driver 314 to rotate the drill string at an intended rotational speed indicated by the RPM command 312.

Operational status information 322, 324, 326 may be received or recorded by the direct controller 304 comprising the algorithm 311. The downhole status information 326 may be communicated to the direct controller 304 directly from the downhole sensors or the downhole status information 326 may be communicated to the direct controller 304 via the coordinated controller 306. The direct controller 304 may then determine or update the RPM command 312 based on the status information 322, 324, 326. The updated RPM command 312 may then be communicated to the actuator controller 302 via the other direct controller 304 to cause the driver 314 rotate the drill string at an updated intended rotational speed indicated by the updated RPM command 312. The direct controller 304 may continually receive the operational status information 322, 324, 326, execute the algorithm 311 based on the latest operational status information 322, 324, 326 to determine an updated RPM command 312, and transmit the updated RPM command 312 to the actuator controller 302 to control the rotation of the drill string.

Figure 8:
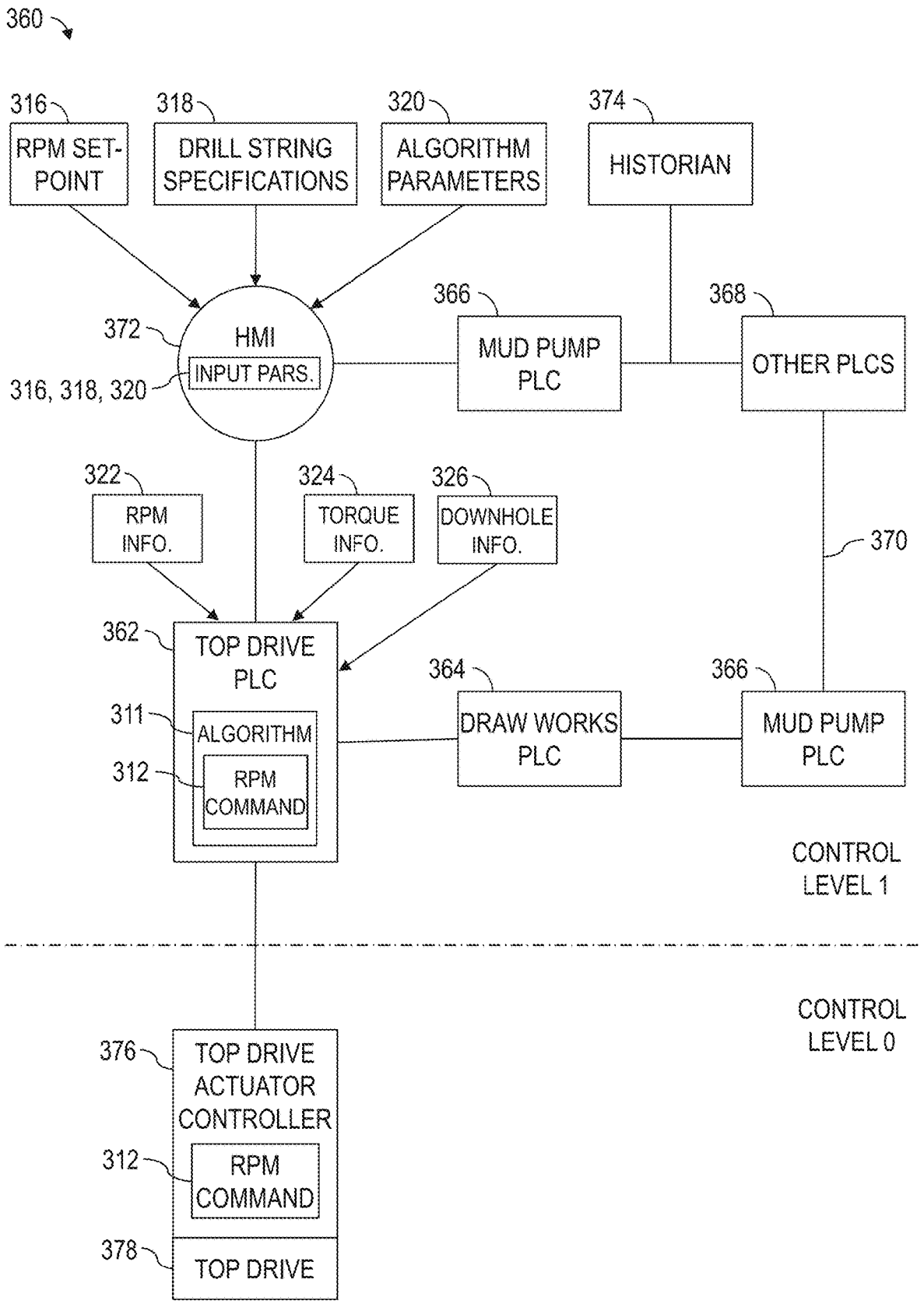
FIG. 8 is a schematic view of at least a portion of an example implementation of apparatus according to one or more aspects of the present disclosure.

FIG. 8 is a schematic view of at least a portion of an example implementation of a control system 360 according to one or more aspects of the present disclosure that may implement a stick-slip algorithm to control rotational speed of a drill string of a well construction system, such as the well construction system 100 shown in FIG. 1. The control system 360 is shown divided into control levels 0 and 1, each comprising corresponding one or more equipment controllers. The control system 360 comprises one or more features and/or modes of operation of the control systems 200, 300, 310, 330, 340, 350 shown in FIGS. 2-7, respectively, including where identified by the same numerals. Accordingly, the following description refers to FIGS. 1-8, collectively.

The control system 360 may comprise a plurality of equipment controllers implemented as PLCs, each operable to control corresponding one or more pieces of wellsite equipment. For example, the control system 360 comprises a PLC 362 operable to control a top drive, a PLC 364 operable to control a draw works, PLCs 366 each operable to control a corresponding mud pump, and other PLCs 368 for controlling other pieces of equipment of the well construction system. It is to be understood that one or more of the PLCs 362, 364, 366, 368 may be operable to control a plurality of pieces of equipment. For example, one of the PLCs 362, 364 may control both the top drive and the draw works. The PLCs 362, 364, 366, 368 may be or comprise level 1 equipment controllers and may be communicatively connected via a communication network 370. The control system 360 may further comprise an HMI 372 communicatively connected with the network 370 and, thus, with one or more of the PLCs 362, 364, 366, 368, such as may permit a human wellsite operator to control and/or otherwise interact (e.g., turn on/off, adjust set-points, etc.) with the wellsite equipment. The communication network 370 may be a field bus communication network utilizing field bus protocols for industrial network systems, such as may be utilized for real time distributed controls standardized in IEC 61158 or other Ethernet based real time communication protocols. Examples of field bus communication protocols include Modbus, Modbus TCP, ProfiBus, ProfiNet, EtherNet/IP, and Ethernet PowerLink. Although the network 370 is shown comprising a ring topology, it is to be understood that the PLCs 362, 364, 366, 368 of the control system 360 may be connected via another network topology, such as a bus topology, a star topology, and mesh topology, among other example. The control system 360 may further comprise a historian 374 to record parameters and other information communicated by the network 370.

In an example implementation of the control system 360, a stick-slip algorithm according to one or more aspects of the present disclosure may be implemented within control level 1 of the control system 360. For example, a stick-slip algorithm 311 may be imparted on and/or executed by the top drive PLC 362. User input parameters, such as an RPM set point 316, drill string specifications 318, and algorithm parameters 320 may be entered into the top drive PLC 362 by a human wellsite operator via the HMI 372 and transmitted to the top drive PLC 362 to configure the algorithm 311. The top drive PLC 362 may then execute program code instructions comprising the stick-slip algorithm to generate an RPM command 312 based on the RPM set point 316, the drill string specifications 318, and the algorithm parameters 320. The top drive PLC 362 may then pass the RPM command 312 to the top drive actuator controller 376 (e.g., a VFD) to control rotation of the top drive 378 and, thus, the drill string. During drilling operations, the top drive PLC 362 may receive RPM status information 322, torque status information 324, and/or downhole status information 326, and continually execute the algorithm 311 based on the latest operational status information 322, 324, 326 to determine an updated RPM command 312. The top drive PLC 362 may then transmit the updated RPM command 312 to the top drive actuator controller 376 to control the rotation of the drill string based on the updated RPM command 312.

Figure 9:
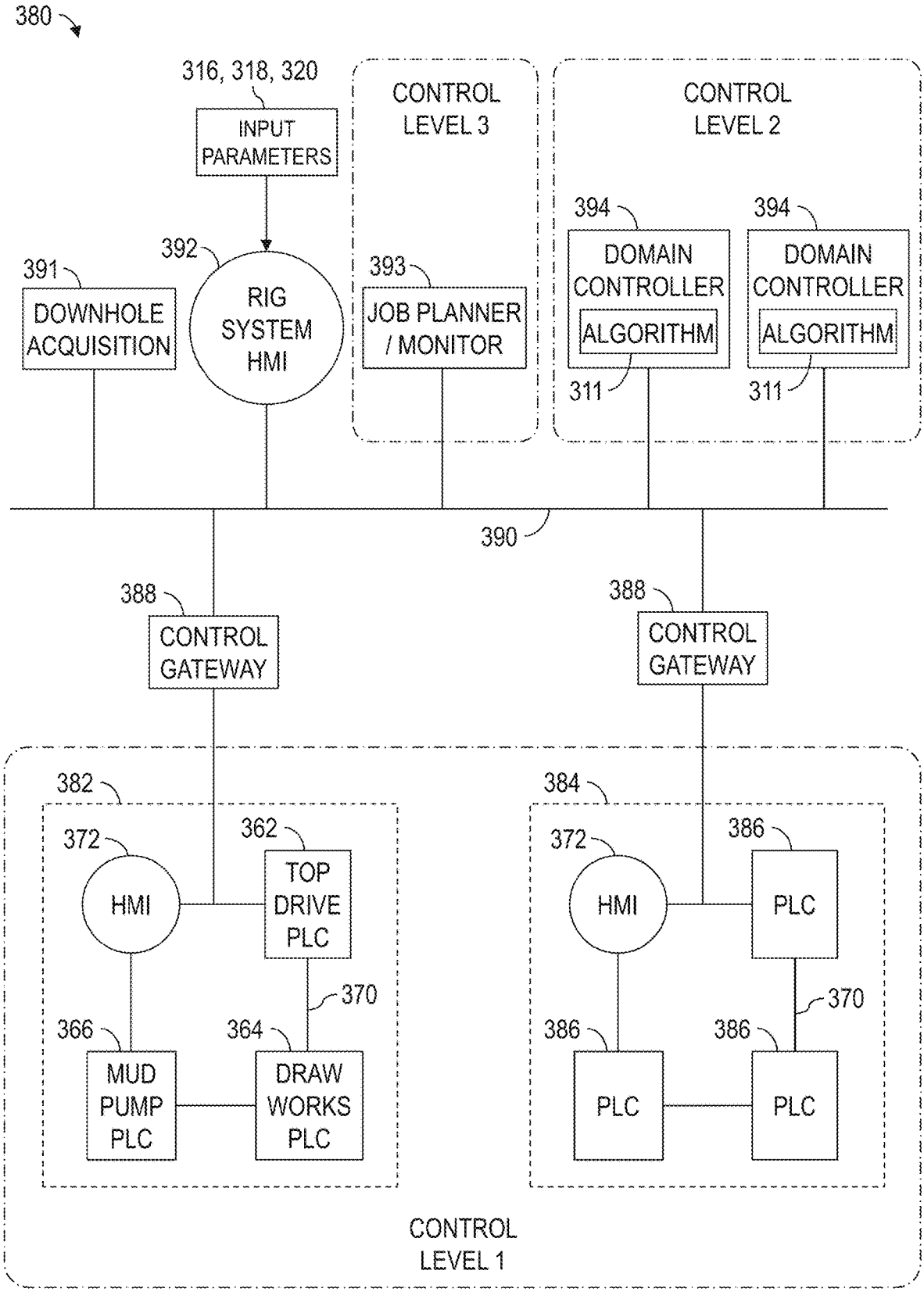
FIG. 9 is a schematic view of at least a portion of an example implementation of apparatus according to one or more aspects of the present disclosure.

FIG. 9 is a schematic view of at least a portion of an example implementation of a control system 380 according to one or more aspects of the present disclosure that may implement a stick-slip algorithm to control rotational speed of a drill string of a well construction system, such as the well construction system 100 shown in FIG. 1. The control system 380 is shown divided into control levels 1, 2, and 3, each comprising corresponding one or more equipment controllers. The control system 380 comprises one or more features and/or modes of operation of the control systems 200, 300, 310, 330, 340, 350, 360 shown in FIGS. 2-8, respectively, including where identified by the same numerals. Accordingly, the following description refers to FIGS. 1-9, collectively.

The control system 380 may be operable to control one or more well construction subsystems, such as the subsystems 211-215 of the well construction system 100 shown in FIGS. 1 and 2. The control system 380 may comprise a plurality of control subsystems, each communicatively connected with and operable to control equipment of a corresponding subsystem 211-215. For example, the control system 380 may comprise a control subsystem 382 communicatively connected with and operable to control equipment of the RC system 211. The control subsystem 382 may comprise one or more features and/or modes of operation of the control system 360 shown in FIG. 8. The control subsystem 382 may comprise a top drive PLC 362 operable to control a top drive, a draw works PLC 364 operable to control a draw works, and a mud pump PLC 366 operable to control a mud pump. The PLCs 362, 364, 366 may be or comprise level 1 direct controllers 304 and may be communicatively connected via a field bus communication network 370. The control subsystem 382 may further comprise an HMI 372 communicatively connected with the network 370 and, thus, with one or more of the PLCs 362, 364, 366. The control system 380 may further comprise a control subsystem 384 communicatively connected with and operable to control equipment of the MPDC system 213, and may comprise a plurality of PLCs 386 operable to control corresponding equipment of the MPDC system 213, such as an RCD and a choke manifold. The PLCs 386 may be or comprise level 1 direct controllers 304 and may be communicatively connected via a corresponding field bus communication network 370. The control subsystem 384 may further comprise a corresponding HMI 372 communicatively connected with the network 370 and, thus, one or more of the PLCs 386.

Although not shown, the control system 380 may further comprise one or more other control subsystems, each communicatively connected with and operable to control equipment of a corresponding well construction subsystem, such as the FC system 212, the CPC system 214, and the WC system 215.

Corresponding control gateways 388 may be provided to encapsulate each of the control subsystems, such as the control subsystems 382, 384, and to expose various sensor data and control commands of the control subsystems to a real-time communication data bus 390 of the control system 380. Communications on the real time communication data bus 390 may be via a communication protocol, such as TCP/IP and/or UDP.

The control system 380 may further comprise a plurality of devices communicatively connected with the data bus 390 and, thus, communicatively connected with the control subsystems, including the control subsystems 382, 384. For example, a downhole acquisition system 391 may be communicatively connected with the data bus 390, such as may facilitate acquisition of drilling and other downhole measurement data. The downhole acquisition system 391 may be or comprise downhole sensors operable to acquire downhole status information (i.e., measurement data) related to a BHA, a wellbore that is being formed, and/or a formation through which the wellbore extends. The control system 380 may further comprise a rig system HMI 392 communicatively connected with the communication data bus 390. The rig system HMI 392 may permit a human wellsite operator to control and/or otherwise interact with selected portions of the control system 380, such as the control subsystems 382, 384, and, thus, facilitate control of the corresponding well construction subsystems 211, 213.

A job planner and/or an operation monitoring device 393 may be communicatively connected with the data bus 390. The job planner and/or operation monitoring device 393 may contain, monitor, and/or collect operational data, such as information from offset wells, job planning or operational sequence data for an ongoing job, drilling status information, and drilling equipment information, including information indicative of operational status of the drill string, the BHA, and/or other equipment. The job planner and/or operation monitoring device 393 may be or comprise a level 3 process monitoring device.

One or more domain controllers 394 may be communicatively connected with the data bus 390. The domain controllers 394 may be operable to receive signals or information via the communication data bus 390, which may include control commands from the rig system HMI 392, status information from the job planner and/or operation monitoring device 393, and sensor data from the downhole acquisition 391. The domain controllers 394 may be operable to issue control commands to controllable equipment of the well construction subsystems 211-215, such as a top drive via the top drive PLC 362 of the control subsystem 382, and a choke manifold via a corresponding PLC 386 of the control subsystem 384. Each domain controller 394 may contain an arbitration mechanism to prevent more than one domain controller 394 from controlling the same controllable equipment at the same time. The domain controllers 394 may be or comprise level 2 coordinated controllers.

In an example implementation of the control system 380, a stick-slip algorithm according to one or more aspects of the present disclosure may be implemented within control level 2 of the control system 380. For example, a stick-slip algorithm 311 may be imparted on and/or executed by one or more of the domain controllers 394. User input parameters, such as an RPM set point 316, drill string specifications 318, and algorithm parameters 320 may be entered via the rig system HMI 392 by a human wellsite operator and transmitted to the domain controller 394 to configure the stick-slip algorithm 311. RPM status information, torque status information, and/or downhole status information may be received by the domain controller 394, which may then generate and continually update an RPM command based on the RPM set point 316, the drill string specifications 318, the algorithm parameters 320, the RPM status information 322, the torque status information 324, and/or the downhole status information 326. The RPM command may then be passed to the top drive PLC 362 via the data bus 390, the corresponding control gateway 388, and the field bus 370. The top drive PLC 362 may then pass the RPM command to a top drive actuator controller to control rotation of the top drive and, thus, the drill string.

By implementing the stick-slip algorithm in a domain controller 394 of control level 2, a human wellsite operator may gain improved control of downhole drill string oscillations. For example, by having access to offset well data, the domain controllers 394 may be automated, such as to start dampening operations in well zones where downhole oscillations are most severe. With access to the downhole acquisition data, the domain controllers 394 may use the downhole vibration data as a feedback to tune control parameters to optimize or improve oscillation control. Furthermore, with access to job planning data, the domain controllers 394 may be automated to start and stop at optimal or otherwise predetermined times during drilling operations.

A domain controller 394 may be a coordinated controller that controls a top drive via a top drive PLC 362 to control rotational speed of a drill string in accordance with an output (e.g., an RPM command) of a stick-slip algorithm 311. However, when utilizing a primary (e.g., built-in) control system (e.g., control system 450 shown in FIG. 11), the primary control system may directly control the top drive to control rotational speed of the drill string and the domain controller 394 may control the top drive to control the rotational speed of the drill string around or proximal to the intended rotational speed in accordance with an output of the stick-slip algorithm 311. Use of a domain controller 394 may permit other existing control systems to be modified, such as to implement control methods in accordance with a stick-slip algorithm 311.

In an example implementation of the control system 380, a stick-slip algorithm according to one or more aspects of the present disclosure may be implemented within control level 1 of the control system 380. For example, the stick-slip algorithm may be imparted on and/or executed by the top drive PLC 362. User input parameters, such as an RPM set point 316, drill string specifications 318, and algorithm parameters 320 may be entered into the top drive PLC 362 via the rig system HMI 392 and/or the local HMI 372 to configure the stick-slip algorithm. The top drive PLC 362 may then receive RPM status information, torque status information, and/or downhole status information. The algorithm may then be executed to generate and continually update an RPM command based on the RPM status information, the torque status information, and/or the downhole status information. The top drive PLC 362 may pass the RPM command to the top drive actuator controller to control rotation of the top drive and, thus, the drill string.

In an example implementation of the control system 380, one or more of the domain controllers 394 and the top drive PLC 362 may receive information from one or more of the HMIs 372, 392, the job planner 393, the downhole acquisition system 391, rotational speed sensors, and torque sensors via the communication data bus 390 and/or the field bus 370. Based on such information, the domain controller 394 or the top drive PLC 362 may issue an RPM command and issue outputs to the corresponding HMI 372, 392. Downhole status information may be used as feedback to tune control input parameters 316, 318, 320. However, if the downhole status information is not available, the RPM and torque status information at the wellsite surface may be utilized in a similar manner as feedback. Both such methods may mandate a time scale that is longer (e.g., tens of seconds) than a typical stick-slip time scale. During operations, the control system 380 may, for example: note the level of surface torque fluctuations; utilize the stick-slip algorithm 311 with an initial set of control input parameters 316, 318, 320; measure new level (fluctuations) of surface torque and/or rotational speed; modify the control input parameters 316, 318, 320; and measure the new level of surface torque and/or rotational speed fluctuations, with the aim to minimize the surface torque and/or rotational speed fluctuations by optimizing the control input parameters 316, 318, 320. If the downhole status information 326 is available, downhole rotational speed fluctuation status information may be utilized in addition to or instead of the surface torque and/or rotational speed status information. Although the method and system of using operational status information as feedback information utilized to optimize or otherwise modify the input parameters 316, 318, 320 to minimize surface torque and/or rotational speed fluctuations is described in association with the control system 380, it is to be understood that such method and system may be implemented in association with each control system within the scope of the present disclosure.

Figure 10:
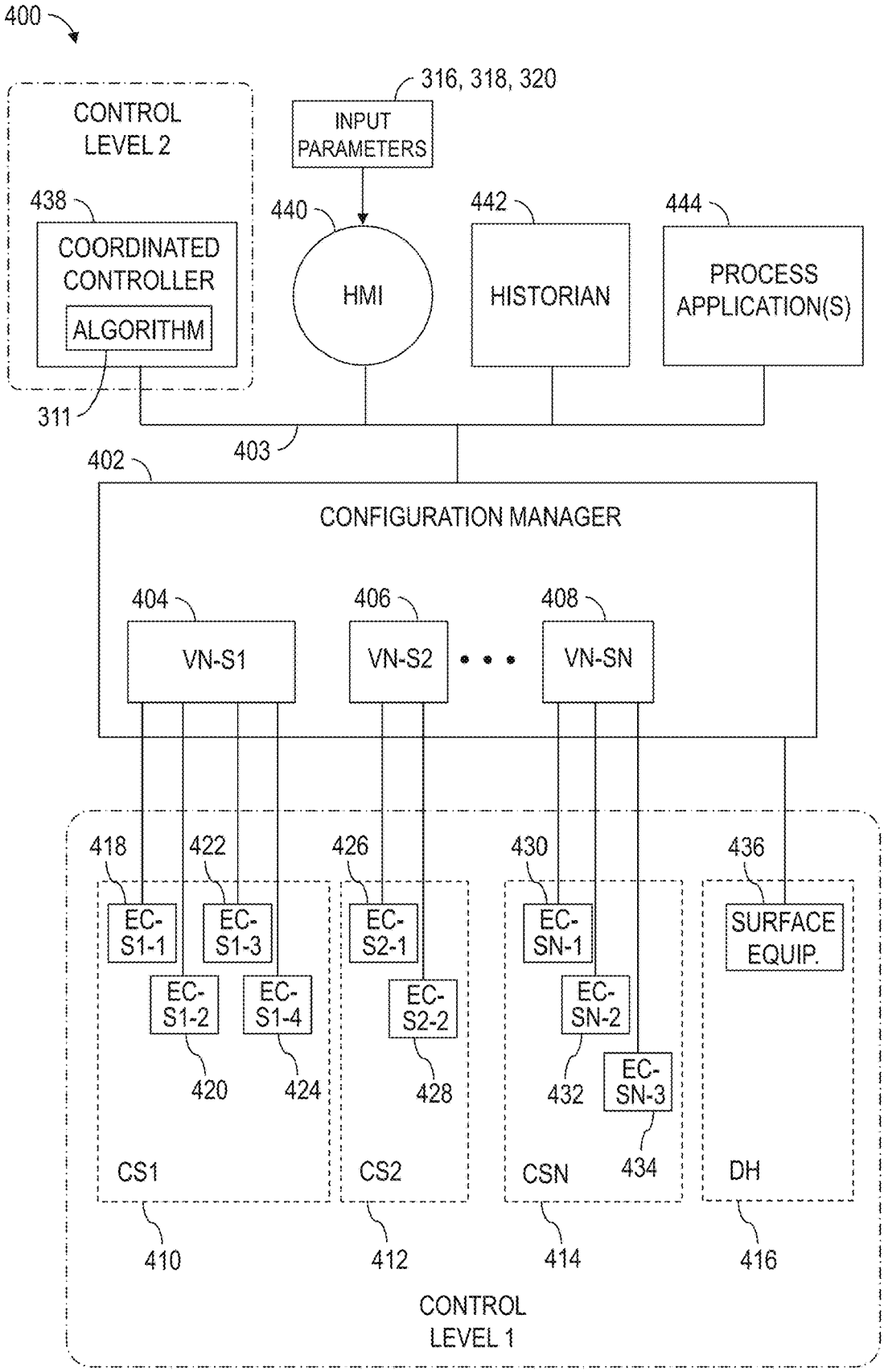
FIG. 10 is a schematic view of at least a portion of an example implementation of apparatus according to one or more aspects of the present disclosure.

FIG. 10 is a schematic view of at least a portion of another example implementation of a control system 400 according to one or more aspects of the present disclosure that may implement a stick-slip algorithm to control rotational speed of a drill string of a well construction system, such as the well construction system 100 shown in FIG. 1. The control system 400 comprises one or more features and/or modes of operation of the control systems 200, 300, 310, 330, 340, 350, 360, 380 shown in FIGS. 2-9, respectively, including where identified by the same numerals. Accordingly, the following description refers to FIGS. 1-10, collectively.

The control system 400 may permit communication between equipment controllers of different well construction subsystems of a well construction system through virtual networks. Operational status information may be communicated through virtual networks and a common data bus between equipment controllers of different well construction subsystems. Additionally, a coordinated controller can implement control logic to issue control commands to one or more of the equipment controllers through virtual networks and common data bus to thereby control operations of one or more pieces of controllable equipment. The control system 400 may utilize a physical communication network having one or more network topologies, such as a bus topology, a ring topology, a star topology, and/or mesh topology. The control system 400 can include one or more processing systems, such as one or more network appliances (like a switch or other processing system), that is configured to implement various virtual networks, such as virtual local area networks (VLANs).

The control system 400 may include a configuration manager 402, which may be a software program instantiated and operable on one or more processing systems, such as one or more network appliances. The configuration manager 402 may be a software program written in and compiled from a high-level programming language, such as C/C++ or the like. As described in further detail below, the configuration manager 402 may be operable to translate communications from various communications protocols to a common communication protocol and make the communications translated to the common communication protocol available through a common data bus 403, and vice versa. The common data bus 403 may include an application program interface (API) of the configuration manager 402 and/or a common data virtual network (VN-DATA) implemented on one or more processing systems, such as network appliances like switches.

Using a configuration manager, such as the configuration manager 402, can facilitate a simpler deployment of well construction subsystems (e.g., subsystems 211-215 shown in FIG. 2) of the well construction system (e.g., well construction system 100 shown in FIGS. 1 and 2) and associated communications equipment, for example. The use of a software program compiled from a high level language can facilitate deployment of an updated version of a configuration manager when an additional subsystem is deployed, which may alleviate deployment of physical components associated with the configuration manager. Further, applications that access data from the configuration manager (e.g., through the common data bus 403) can be updated through a software update when new data becomes available by the addition of a new subsystem, such that the updated application can consume data generated by the new subsystem.

One or more processing systems of the control system 400, such as one or more network appliance like switches, may be configured to implement one or more subsystem virtual networks (e.g., VLANs), such as a first subsystem virtual network (VN-S1) 404, a second subsystem virtual network (VN-S2) 406, and an Nth subsystem virtual network (VN-SN) 408, as shown in FIG. 10. More or fewer subsystem virtual networks may be implemented. The subsystem virtual networks (e.g., virtual networks 404, 406, 408) are logically separate from each other. The subsystem virtual networks can be implemented according to the IEEE 802.1Q standard, another standard, or a proprietary implementation. Each of the subsystem virtual networks can implement communications with the equipment controller(s) of the respective subsystem based on a protocol, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol. Further, the subsystem virtual networks can implement publish-subscribe communications. The subsystem virtual networks can implement the same protocol, each subsystem virtual network can implement a different protocol, or a combination therebetween.

A first control subsystem (CS1) 410, a second control subsystem (CS2) 412, and an Nth control subsystem (CSN) 414 represent various control subsystems for the well construction subsystems. As described above, and shown in FIG. 2, example well construction subsystems may include an RC system 211 (which may include hoisting equipment, drivers (such as a top drive and/or rotary table), a PHM, a catwalk, etc.), an FC system 212 (which may include mud pumps, valves, fluid reconditioning equipment, etc.), an MPDC system 213, a cementing system, and a rig walk system, among other examples. A well construction subsystem may include a single piece of equipment or may include multiple pieces of equipment, for example, that are jointly used to perform one or more operations. Each control subsystem includes one or more equipment controllers, which may control equipment and/or receive sensor data and/or status information from sensors and/or equipment.

The first control system 410 may include a first equipment controller (EC-S1-1) 418, a second equipment controller (EC-S1-2) 420, a third equipment controller (EC-S1-3) 422, and a fourth equipment controller (EC-S1-4) 424. The second control system 412 may include a first equipment controller (EC-S2-1) 426 and a second equipment controller (EC-S2-2) 428. The Nth control system 414 may include a first equipment controller (EC-SN-1) 430, a second equipment controller (EC-SN-2) 432, and a third equipment controller (EC-SN-3) 434. A number of control subsystems may be implemented, and a number of equipment controllers may be used in a control subsystem. The equipment controllers of each control subsystem may be or comprise control level 1 direct controllers, such as PLCs. Some example control subsystems are described below following description of various aspects of the control system 400.

Each equipment controller can implement logic to monitor and/or control one or more sensors and/or one or more pieces of controllable equipment of the respective well construction subsystem. Each equipment controller can include logic to interpret a control command, operational status information, and/or other data, such as from one or more sensors or pieces of controllable equipment, and to communicate a signal to one or more pieces of controllable equipment of the well construction subsystem to control the one or more pieces of controllable equipment in response to the control command, operational status information, and/or other data. Each equipment controller can also receive a signal from one or more sensors, can reformat the signal, such as from an analog signal to a digital signal, into interpretable data. The logic for each equipment controller can be programmable, such as compiled from a low level programming language, such as described in IEC 61131 programming languages for PLCs, structured text, ladder diagram, functional block diagrams, functional charts, or the like.

The control system 400 is further shown comprising a downhole system (DH) 416, representing an example sensor system of the well construction system. The downhole system 416 includes surface equipment 436 that is communicatively coupled to a BHA of a drill string. The surface equipment 436 receives data from the BHA indicative of conditions in the wellbore. Other sensor subsystems can be included in the control system 400 and other sensor subsystems may be implemented.

The control system 400 may further comprise a coordinated controller 438, which may be a software program instantiated and operable on one or more processing systems, such as one or more network appliances. The coordinated controller 438 may be a software program written in and compiled from a high-level programming language, such as C/C++ or the like. The coordinated controller 438 can control operations of the well construction subsystems and communications between the well construction subsystems as described in further detail below. The coordinated controller 438 may be or comprise a control level 2 controller, such as an industrial PC or a PLC.

The control system 400 may also include one or more HMIs, such as HMI 440. The HMI 440 can may be, comprise, or be implemented by a processing system with a keyboard, a mouse, a touchscreen, a joystick, one or more control switches or toggles, one or more buttons, a trackpad, a trackball, an image/code scanner, a voice recognition system, a display device (such as a liquid crystal display (LCD), a light-emitting diode (LED) display, and/or a cathode ray tube (CRT) display), a printer, speaker, and/or other examples. The HMI 440 may facilitate entry of input parameters and other commands to the coordinated controller 438 and for visualization or other sensory perception of various data, such as operational status information (e.g., sensor data) and/or other example data. In some examples, an HMI may be a part of a control subsystem and can issue control commands through a subsystem virtual network to one or more of the equipment controllers of that subsystem virtual network without using the coordinated controller 438. Each HMI can be associated with and control a single or multiple well construction subsystems. In a further example, an HMI can control an entirety of the well construction system that includes each well construction subsystem.

The control system 400 may include a historian 442, such as a database maintained and operated on one or more processing systems (e.g., database devices). The historian 442 can be distributed across multiple processing systems and/or may be maintained in memory, which can include external storage, such as a hard disk or drive. The historian 442 may access operational status information stored and maintained in the historian 442.

The control system 400 may further include one or more process applications 444, which may be a software program instantiated and operable on one or more processing systems, such as one or more network appliances, such as server devices. The process applications 444 may each be a software program written in and compiled from a high-level programming language, such as C/C++ or the like. The process applications 444 may analyze data and output information to, for example, construction personnel to inform various construction operations. In some examples, the process applications 444 can output control commands for various equipment controllers for controlling well construction operations.

Referring to communications within the control system 400, each equipment controller within a control subsystem can communicate with other equipment controllers in that control subsystem through the subsystem virtual network for that control subsystem (e.g., through processing systems configured to implement the subsystem virtual network). Operational status information and/or control commands from an equipment controller in a well construction subsystem can be communicated to another equipment controller within that well construction subsystem through the subsystem virtual network for that well construction subsystem, for example, which may occur without intervention of the coordinated controller 438. For example, equipment controller 418 can communicate the operational status information and/or control commands to equipment controller 422 through the virtual network 404, and vice versa. Other equipment controllers within a subsystem can similarly communicate through their respective subsystem virtual network.

Communications from a subsystem virtual network to another processing system outside of that well construction subsystem and respective subsystem virtual network can be translated from the communications protocol used for that subsystem virtual network to a common protocol, such as data distribution service (DDS) protocol or another, by the configuration manager 402. The communications that are translated to a common protocol can be made available to other processing systems through the common data bus 403, for example. Operational status information and control commands from the control subsystems (e.g., control subsystems 410, 412, 414) may be available (e.g., directly available) for consumption by, for example, equipment controllers of different well construction subsystems, the coordinated controller 438, the HMI 440, the historian 442, and/or the process applications 444 from the common data bus 403. Equipment controllers can communicate the operational status information to another equipment controller in another well construction subsystem through the common data bus 403. For example, if a sensor in the first control system 410 communicates a signal to the equipment controller 418 and the data generated by that sensor is also used by the equipment controller 426 in the second control system 412 to control one or more pieces of controllable equipment of the second control system 412, the sensor data can be communicated from the equipment controller 418 through the virtual network 404, the common data bus 403, and virtual network 406 to the equipment controller 426. Other equipment controllers within the various well construction subsystems can similarly communicate operational status information and control commands through the common data bus 403 to one or more other equipment controllers in different well construction subsystems. Similarly, for example, if one or more of the process applications 444 consume data generated by a sensor coupled to the equipment controller 418 in the first control system 410, the sensor data can be communicated from the equipment controller 418 through the virtual network 404 and the common data bus 403, where the one or more process applications 444 can access and consume the sensor data.

Similarly, communications from a sensor subsystem (e.g., the downhole system 416) can be translated from the communications protocol used for that sensor subsystem to the common protocol by the configuration manager 402. The communications that are translated to a common protocol can be made available to other processing systems through the common data bus 403, for example. Similar to above, sensor data and/or status data from the sensor subsystem may be available (e.g., directly available) for consumption by, e.g., equipment controllers of control subsystems, the coordinated controller 438, HMI 440, historian 442, and/or process applications 444 from the common data bus 403.

The coordinated controller 438 can control issuance of control commands to equipment controllers from a source outside of the equipment controllers' respective subsystem virtual network. For example, one or more equipment controllers can issue a command to one or more equipment controllers in another well construction subsystem through respective subsystem virtual networks and the common data bus 403 under the control of the coordinated controller 438. As another example, the HMI 440 and/or process applications 444 can issue a command to one or more equipment controllers in a well construction subsystem through the common data bus 403 under the control of the coordinated controller 438 and through the subsystem virtual network of that well construction subsystem. For example, a user may input commands through the HMI 440 to control an operation of a well construction subsystem. Control commands to an equipment controller of a well construction subsystem from a source outside of that well construction subsystem may be prohibited in the control system 400 without the coordinated controller 438 processing the command. The coordinated controller 438 can implement logic to determine whether a given equipment controller of one well construction subsystem, the HMI 440, and/or process applications 444 can issue a control command to another given equipment controller in a different well construction subsystem.

The coordinated controller 438 can implement logic to arbitrate the operation of selected equipment or well construction subsystem, such as when there are multiple actors (e.g., equipment controllers and/or HMIs) attempting to send commands to the same equipment or well construction subsystem at the same time. The coordinated controller 438 can implement logic to determine which of conflicting control commands from HMIs and/or equipment controllers of different well construction subsystems to issue to another equipment controller. For example, if equipment controller 418 issues a control command to equipment controller 430 to increase a pumping rate of a pump, and equipment controller 426 issues a control command to equipment controller 430 to decrease the pumping rate of the same pump simultaneously, the coordinated controller 438 will resolve the conflict and determines which control command (from equipment controller 418 or equipment controller 426) is permitted to proceed. Additionally, as an example, if two HMIs issue conflicting control commands simultaneously, the coordinated controller 438 can determine which control command to prohibit and which control command to issue.

The coordinated controller 438 can also implement logic to control operations of the well construction system. The coordinated controller 438 can monitor various statuses of components and/or sensors and can issue control commands to various equipment controllers to control the operation of the controllable equipment within one or more well construction subsystems. Operational status information can be monitored by the coordinated controller 438 through the common data bus 403, and the coordinated controller 438 can issue control commands to one or more equipment controllers through the respective subsystem virtual network of the equipment controller. The controllable equipment may be controlled by a digital signal and/or analog signal from an equipment controller. Signals from sensors associated with a piece of controllable equipment can also be sent to and received by one or more equipment controllers, which can then transmit the sensor data to the common data bus 403 and/or use the data to responsively control controllable equipment, for example. The signals from the sensor that are received by an equipment controller may be a digital signal and/or analog signal.

In an example implementation of the control system 400, a stick-slip algorithm according to one or more aspects of the present disclosure may be implemented within control level 2 of the control system 400. For example, a stick-slip algorithm 311 may be imparted on and/or executed by the coordinated controller 438. User input parameters, such as an RPM set point 316, drill string specifications 318, and algorithm parameters 320 may be entered by a human wellsite operator via the HMI 440 to configure the stick-slip algorithm 311. RPM status information, torque status information, and/or downhole status information may be received by the coordinated controller 438, which may then execute the stick-slip algorithm 311 to generate an RPM command based on the RPM set point 316, the drill string specifications 318, the algorithm parameters 320, the RPM status information 322, the torque status information 324, and/or the downhole status information 326. The RPM command may then be passed to an equipment controller (e.g., equipment controller 418, which may be top drive PLC) via the common data bus 403 and a virtual network (e.g., virtual network 404). The equipment controller 418 may then pass the RPM command to an actuator controller (e.g., a top drive actuator controller) to control rotation of a driver (e.g., a top drive) and, thus, the drill string. The equipment controller 418 may continually update the RPM command based on latest received RPM status information, torque status information, and/or downhole status information.

In another example implementation of the control system 400, a stick-slip algorithm according to one or more aspects of the present disclosure may be implemented within control level 1 of the control system 400. For example, a stick-slip algorithm may be imparted on and/or executed by the equipment controller 418 (e.g., top drive PLC). User input parameters, such as an RPM set point 316, drill string specifications 318, and algorithm parameters 320 may be entered into the equipment controller 418 via the HMI 440 or another HMI associated with the control subsystem 410, and used to configure the algorithm. The equipment controller 418 may then receive the RPM status information 322, the torque status information 324, and/or the downhole status information 326, and execute the algorithm to generate an RPM command based on the RPM set point 316, the drill string specifications 318, the algorithm parameters 320, the RPM status information 322, the torque status information 324, and/or the downhole status information 326. The equipment controller 418 may then pass the RPM command to an actuator controller (e.g., a top drive actuator controller) to control rotation of a driver (e.g., a top drive) and, thus, the drill string. The equipment controller 418 may continually update the RPM command based on latest received RPM status information, torque status information, and/or downhole status information.

Figure 11:
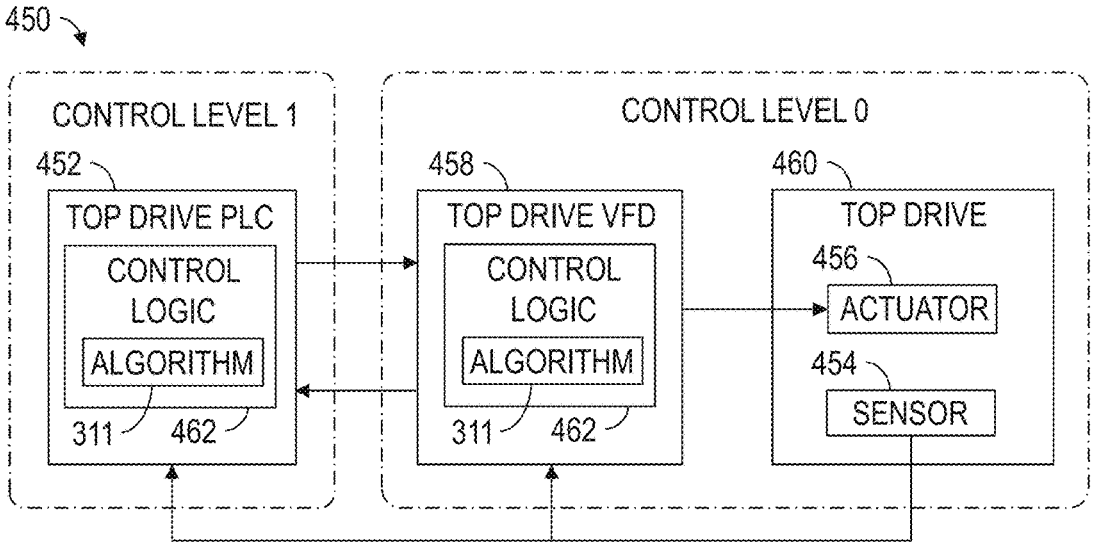
FIG. 11 is a schematic view of at least a portion of an example implementation of apparatus according to one or more aspects of the present disclosure.

FIG. 11 is a schematic view of at least a portion of a control system 450 according to one or more aspects of the present disclosure. The control system 450 may be or form a portion of one or more of the control systems 200, 300, 310, 330, 340, 350, 360, 380, 400 shown in FIGS. 2-10, respectively. Accordingly, the following description refers to FIGS. 1-11, collectively.

The control system 450 may comprise an equipment controller 452 of control level 1 communicatively connected with an equipment controller 458 of control level 0. The equipment controller 452 may be or comprise an example implementation of one or more of the control level 1 equipment controllers 304, 362, 418 shown in one or more of FIGS. 3-10 and equipment controller 458 may be or comprise an example implementation of one or more of the control level 0 equipment controllers 302, 376 shown in one or more of FIGS. 3-8. An example implementation of the control system 450 may be utilized for controlling rotational speed of a top drive 460. Accordingly, the equipment controller 452 may be or comprise a top drive PLC 452 and the equipment controller 458 may be or comprise a top drive actuator VFD 458. Although shown as separate and distinct components, the top drive actuator VFD 458 may form a portion of or be disposed in association with the top drive 460. The top drive 460 may comprise a top drive actuator 456, such as a top drive motor, a transmission gear shifting actuator, and an elevator position actuator, among other examples. The top drive actuator 456 may be operated by the corresponding top drive actuator VFD 458, such as for controlling electrical current and/or voltage supplied to the top drive actuator 456. The control system 450 may further comprise a sensor 454 disposed in association with a corresponding portion of the top drive 460 and/or drill string. The sensor 454 may be or comprise a hook load sensor, a surface torque sensor, a rotational speed sensor, and/or an electrical sensor for measuring electrical current and/or voltage applied to the top drive 460 actuator 456, among other examples. Although the control system 450 is shown comprising a single top drive PLC 452, a single VFD 458, a single actuator 456, and a single sensor 454, it is to be understood that the control system 450 may comprise a plurality of VFDs 458, actuators 456, and sensors 454 communicatively connected with the top drive PLC 452 or with a corresponding top drive PLC 452.

In an example implementation of the control system 450, a stick-slip algorithm according to one or more aspects of the present disclosure may be implemented within control level 1 of the control system 450. For example, a control logic 462 (e.g., program code instructions) comprising a stick-slip algorithm 311 may be imparted on and/or executed by the top drive PLC 452. Similarly as described above, input parameters, such as an RPM set point, drill string specifications, and algorithm parameters may be entered by a human wellsite operator (e.g., a driller) via an HMI and used to configure the algorithm 311. The top drive PLC 452 may receive operational status information, such as RPM status information, torque status information, and/or downhole status information, and execute the control logic 462 comprising the stick-slip algorithm 311 to generate an RPM command based on the RPM set point, the drill string specifications, the algorithm parameters, the RPM status information, the torque status information, and/or the downhole status information. The top drive PLC 452 may then pass the RPM command to the top drive VFD 458 to control rotation of the top drive 460 and, thus, the drill string.

The RPM and torque status information may be generated, outputted, or otherwise provided by the sensor 454 and transmitted or otherwise inputted to the top drive PLC 452. However, the RPM and torque status information may also or instead be generated, outputted, or otherwise provided by the top drive VFD 458 and transmitted or otherwise inputted to the top drive PLC 452. The top drive PLC 452 may continually receive updated operational status information, execute the algorithm 311 based on the latest operational status information to determine an updated RPM command, and transmit the updated RPM command to the top drive VFD 458 to control the rotation of the drill string.

In an example implementation of the control system 450, a stick-slip algorithm according to one or more aspects of the present disclosure may be implemented within control level 0 of the control system 450. For example, a control logic comprising a stick-slip algorithm 311 may be imparted on and/or executed by the top drive VFD 458. User input parameters, such as an RPM set point, drill string specifications, and algorithm parameters may be entered via an HMI and communicated to the top drive VFD 458, perhaps via the top drive PLC 452, to configure the algorithm 311. The control logic comprising stick-slip algorithm 311 may then be executed by the top drive VFD 458 to generate an RPM command based on the RPM set point, the drill string specifications, and the algorithm parameters. The top drive VFD 458 may then transmit a corresponding power signal to the top drive actuator 456 (e.g., motor) to control rotation of the top drive 460 and, thus, the drill string.

During drilling operations, the top drive VFD 458 may continually utilize operational status information, such as RPM status information, torque status information, and/or downhole status information to generate or update the RPM command. The RPM and torque status information may be generated, outputted, or otherwise provided by the sensor 454 and transmitted or otherwise inputted to the top drive VFD 458. However, the top drive VFD 458 may generate internal control signals and/or measurement signals indicative of intended and/or actual rotational speed and/or torque of the drill string and may utilize such signals as the RPM and torque status information to generate and/or update the RPM command. The top drive VFD 458 may then generate an updated power signal based on the updated RPM command and transmit the updated power signal to the top drive actuator 456 to control rotation of the drill string.

During drilling operations, the top drive VFD 458 may be operable to generate the RPM command at least partially based on the downhole information (e.g., downhole information 326) indicative of operational status (e.g., magnitude of stick-slip action, lateral vibrations, axial vibrations, rotational waves, etc.) of the drill string downhole. The generated RPM command may cause the top drive 460 to rotate the drill string at a substantially constant rotational speed, such as by disengaging the stick-slip control action, when the downhole information is indicative that no stick-slip action is occurring and/or no rotational waves are traveling along the drill string. The generated RPM command may cause the top drive 460 to vary the rotational speed of the drill string to reduce the rotational waves traveling along the drill string when the downhole information is indicative that stick-slip action is occurring and/or rotational waves are traveling along the drill string.

During drilling operations, such as when the downhole information is indicative that the stick-slip action and/or rotational waves traveling along the drill string are not being reduced, the control logic 462 may cause the top drive PLC 452 or top drive VFD 458 to automatically change one or more of the algorithm parameters (e.g., algorithm parameters 320, including numerical parameters) of the stick-slip algorithm 311 based on the downhole information. The changed algorithm parameters may cause the RPM command being generated by the top drive VFD 458 to change, causing the top drive 460 to vary rotational speed of the drill string based on the changed RPM command. The algorithm parameters may be automatically changed at least until the downhole information indicates that the stick-slip action and/or rotational waves traveling along the drill string are eliminated or reduced below a predetermined level.

Figure 12:
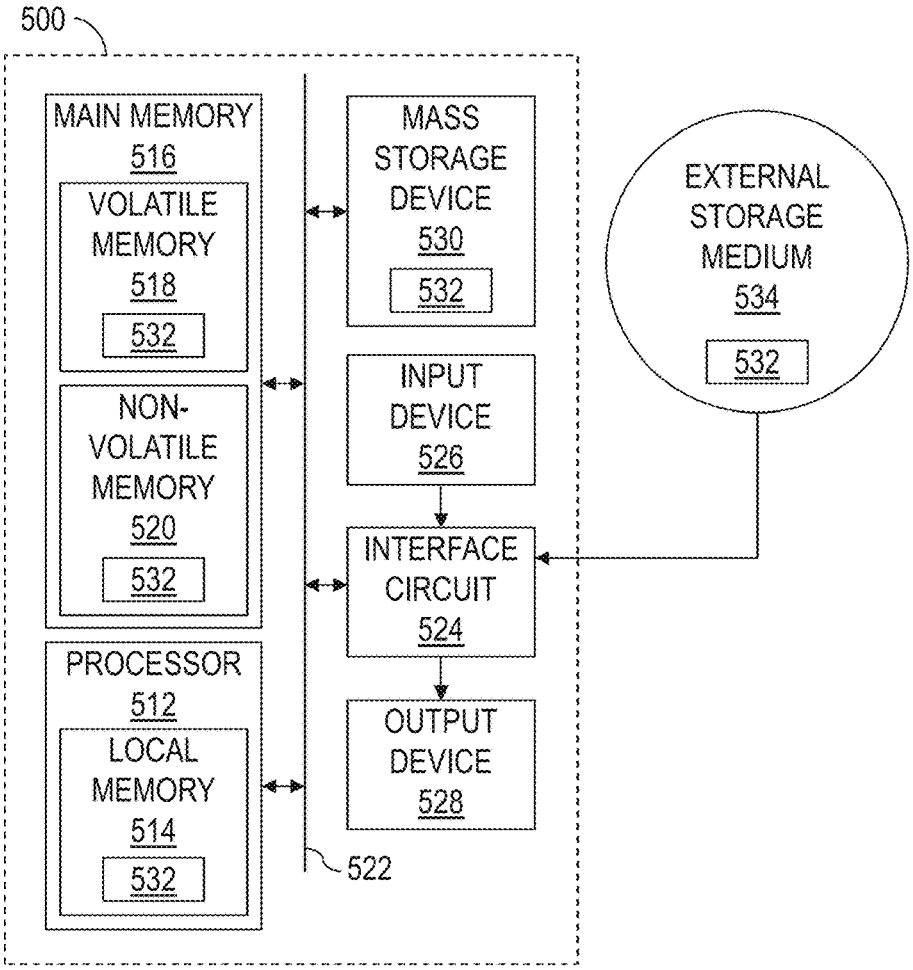
FIG. 12 is a schematic view of at least a portion of an example implementation of apparatus according to one or more aspects of the present disclosure.

FIG. 12 is a schematic view of at least a portion of an example implementation of a processing system 500 according to one or more aspects of the present disclosure. The processing system 500 may be or form at least a portion of one or more equipment controllers and/or other electronic devices shown in one or more of the FIGS. 1-11. Accordingly, the following description refers to FIGS. 1-12, collectively.

The processing system 500 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. As shown in one or more of the FIGS. 1-11, the processing system 500 may be or form at least a portion of the processing devices 188, 192. The processing system 500 may be or form at least a portion of the equipment controllers of control levels 0, 1, 2, and 3, such as the process monitoring device 308, the coordinated controllers 306, the direct controllers 304, and the actuator controllers 302. The processing system 500 may form at least a portion of the domain controllers 394, the coordinated controllers 438, the HMIs 372, 392, 440, the top drive actuator controllers 376, the top drive PLCs 362, 418, the mud pump PLCs 366, and the draw works PLCs 364. Although it is possible that the entirety of the processing system 500 is implemented within one device, it is also contemplated that one or more components or functions of the processing system 500 may be implemented across multiple devices, some or an entirety of which may be at the wellsite and/or remote from the wellsite of a well construction system.

The processing system 500 may comprise a processor 512, such as a general-purpose programmable processor. The processor 512 may comprise a local memory 514, and may execute machine-readable program code instructions 532 (i.e., computer program code) present in the local memory 514 and/or another memory device. The processor 512 may execute, among other things, the program code instructions 532 and/or other instructions and/or programs to implement the example methods and/or operations described herein. The program code instructions 532 stored in the local memory 514, when executed by the processor 512 of the processing system 500, may cause one or more portions or pieces of wellsite equipment of a well construction system to perform the example methods and/or operations described herein. The processor 512 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 512 include one or more INTEL microprocessors, microcontrollers from the ARM and/or PICO families of microcontrollers, embedded soft/hard processors in one or more FPGAs.

The processor 512 may be in communication with a main memory 516, such as may include a volatile memory 518 and a non-volatile memory 520, perhaps via a bus 522 and/or other communication means. The volatile memory 518 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 520 may be, comprise, or be implemented by read-only memory, flash memory, and/or other types of memory devices. One or more memory controllers (not shown) may control access to the volatile memory 518 and/or non-volatile memory 520.

The processing system 500 may also comprise an interface circuit 524, which is in communication with the processor 512, such as via the bus 522. The interface circuit 524 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 524 may comprise a graphics driver card. The interface circuit 524 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing system 500 may be in communication with various sensors, actuators, equipment controllers, and other devices of a well construction system via the interface circuit 524. The interface circuit 524 can facilitate communications between the processing system 500 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 526 may also be connected to the interface circuit 524. The input devices 526 may permit human wellsite operators to enter the program code instructions 532, such as a stick-slip algorithm, RPM set-points, drill string specifications, algorithm parameters, as well as other control commands, operational settings and set-points, and/or processing routines. The input devices 526 may be, comprise, or be implemented by a keyboard, a mouse, a joystick, a touchscreen, a track-pad, a trackball, an isopoint, and/or a voice recognition system, among other examples. One or more output devices 528 may also be connected to the interface circuit 524. The output devices 528 may permit for visualization or other sensory perception of various data, such as sensor data, status data, and/or other example data. The output devices 528 may be, comprise, or be implemented by video output devices (e.g., an LCD, an LED display, a CRT display, a touchscreen, etc.), printers, and/or speakers, among other examples. The one or more input devices 526 and the one or more output devices 528 connected to the interface circuit 524 may, at least in part, facilitate the HMIs described herein.

The processing system 500 may comprise a mass storage device 530 for storing data and program code instructions 532. The mass storage device 530 may be connected to the processor 512, such as via the bus 522. The mass storage device 530 may be or comprise a tangible, non-transitory storage medium, such as a floppy disk drive, a hard disk drive, a compact disk (CD) drive, and/or digital versatile disk (DVD) drive, among other examples. The processing system 500 may be communicatively connected with an external storage medium 534 via the interface circuit 524. The external storage medium 534 may be or comprise a removable storage medium (e.g., a CD or DVD), such as may be operable to store data and program code instructions 532.

As described above, the program code instructions 532 may be stored in the mass storage device 530, the main memory 516, the local memory 514, and/or the removable storage medium 534. Thus, the processing system 500 may be implemented in accordance with hardware (perhaps implemented in one or more chips including an integrated circuit, such as an ASIC), or may be implemented as software or firmware for execution by the processor 512. In the case of firmware or software, the implementation may be provided as a computer program product including a non-transitory, computer-readable medium or storage structure embodying computer program code instructions 532 (i.e., software or firmware) thereon for execution by the processor 512.

The control system 500 may be operable to receive the program code instructions 532, such as stick-slip algorithms, RPM set-points, drill string specifications, algorithm parameters, as well as other user input parameters, operational settings, set-points, and/or processing routines. The control system 500 may be communicatively connected with and operable to receive operational status information (e.g., sensor data, signals, or other information, etc.) indicative of operational status of various equipment or equipment systems of the well construction system. The control system 500 may be further operable to process the program code instructions 532 and the operational status information to generate and output corresponding control commands to one or more pieces of equipment or other controllable devices of the well construction system and, thereby, cause or otherwise implement at least a portion of one or more of the example methods, processes, and/or operations described herein.

Figure 13:
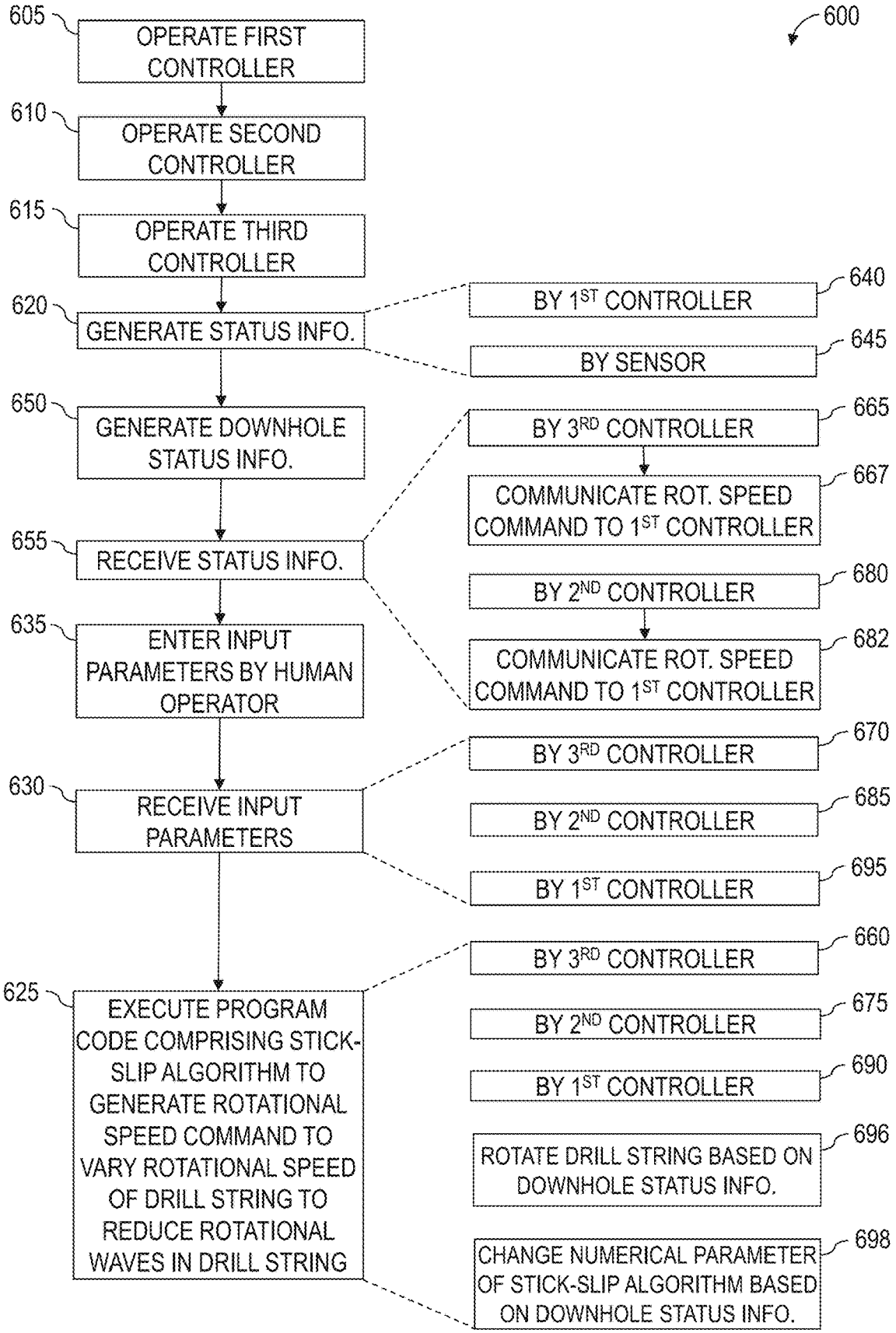
FIG. 13 is a flow-chart diagram of at least a portion of a method according to one or more aspects of the present disclosure.

FIG. 13 is a flow-chart diagram of at least a portion of an example implementation of a process or method (600) according to one or more aspects of the present disclosure. The method (600) may be performed utilizing or otherwise in conjunction with at least a portion of one or more implementations of one or more instances of the apparatus shown in one or more of FIGS. 1-12, and/or otherwise within the scope of the present disclosure. For example, the method (600) may be performed and/or caused, at least partially, by a processing system (e.g., processing system 500 shown in FIG. 12, equipment controllers shown in FIGS. 1-11, etc.) executing program code instructions comprising a stick-slip algorithm according to one or more aspects of the present disclosure. Thus, the following description of the method (600) also refers to apparatus shown in one or more of FIGS. 1-12. However, the method (600) may also be performed in conjunction with implementations of apparatus other than those depicted in FIGS. 1-12 that are also within the scope of the present disclosure.

The method (600) is an example implementation of a method of controlling rotational speed of a drill string 120 during drilling operations according to one or more aspects of the present disclosure. The method (600) may comprise operating (605) a first controller 302 to cause a driver 314 to rotate the drill string 120 to form a wellbore 102 extending into a subterranean formation 106, operating (610) a second controller 304 communicatively connected with the first controller 302, and operating (615) a third controller 306 communicatively connected with the second controller 304. The method (600) may further comprise generating (620) status information 322, 324 indicative of operational status of the drill string 120, and executing (625) by the first, second, and/or third controller 302, 304, 306 program code instructions 532 comprising a stick-slip algorithm 311 to generate a rotational speed command 312 based on the status information 322, 324 thereby causing the driver 314 to vary rotational speed of the drill string 120 based on the rotational speed command 312 to reduce rotational waves traveling along the drill string 120.

The first controller 302 may be an instance of a first tier of controllers each operable to control a corresponding instance of a plurality of actuators, the second controller 304 may be an instance of a second tier of controllers each communicatively connected with a corresponding instance of the first tier of controllers, and the third controller 306 may be communicatively connected with each instance of the second tier of controllers. The first controller 302 may be or comprises a variable frequency drive (VFD), the second controller 304 may be or comprises a programmable logic controller (PLC), and the third controller 306 may be or comprises a personal computer (PC) or an industrial computer (IPC).

The method (600) may further comprise receiving (630) input parameters 316, 318, 320 of the stick-slip algorithm 311 by the first, second, and/or third controller 302, 304, 306, wherein the rotational speed command 312 may be generated based on the status information 322, 324 and input parameters 316, 318, 320. The input parameters 316, 318, 320 may be entered (635) into the first, second, and/or third controller 302, 304, 306 by a human operator 195. The input parameters 316, 318, 320 may be indicative of at least one of intended rotational average speed of the drill string 120 during drilling operations, a physical characteristic of the drill string 120, and a numerical parameter of the stick-slip algorithm 311.

Generating (620) the status information 322, 324 indicative of operational status of the drill string 120 may be performed (640) by the first controller 302. However, generating (620) the status information 322, 324 indicative of operational status of the drill string 120 may also or instead be performed (645) by a sensor 328 disposed in association with the driver 314 and/or drill string 120. The status information 322, 324 may be indicative of at least one of rotational speed of the drill string 120 and torque applied to the tool string by the driver 314.

The status information 322, 324 may comprise first status information 322, 324 indicative of operational status of the drill string 120 at a wellsite surface 104 from which the wellbore 102 extends. Thus, the method (600) may further comprise generating (650) second (downhole) status information 326 indicative of operational status of the drill string 120 downhole within the wellbore 102, wherein the rotational speed command 312 is generated based on the first and second status information 322, 324, 326. The first and/or second status information 322, 324, 326 may then be received (655) by the first, second, and/or third controller 302, 304, 306.

The drill string 120 may be rotated 696 based on the downhole status information 326. For example, the generated rotational speed command 312 may cause the driver 314 to rotate the drill string 120 at a substantially constant rotational speed when the second status information 326 is indicative that no rotational waves are traveling along the drill string 120. Furthermore, the generated rotational speed command 312 may cause the driver 314 to vary the rotational speed of the drill string 120 to reduce the rotational waves traveling along the drill string 120 when the second status information 326 is indicative that the rotational waves are traveling along the drill string 120.

The stick-slip algorithm 311 may comprise numerical parameters. Thus, when the second status information 326 is indicative that the rotational waves traveling along the drill string 120 are not being reduced, the first, second, and/or third controller may execute 625 the program code instructions changing 698 one or more of the numerical parameters of the stick-slip algorithm 311 to change the rotational speed command 312 being generated by the first, second, and/or third controller, thereby causing the driver 314 to vary rotational speed of the drill string 120 to reduce the rotational waves traveling along the drill string 120.

Executing (625) the program code instructions 532 comprising the stick-slip algorithm 311 to generate the rotational speed command 312 may be performed (660) by the third controller 306, wherein the method (600) may further comprise receiving (665) the status information 322, 324 indicative of operational status of the drill string 120 by the third controller 306, and communicating (667) the rotational speed command 312 to the first controller 302 via the second controller 304. The method (600) may further comprise receiving (670) input parameters 316, 318, 320 of the stick-slip algorithm 311 by the third controller 306, wherein the rotational speed command 312 may be generated based on the received status information 322, 324 and input parameters 316, 318, 320.

Executing (625) the program code instructions 532 comprising the stick-slip algorithm 311 to generate the rotational speed command 312 may be performed (675) by the second controller 304, wherein the method (600) may further comprise receiving (680) the status information 322, 324 indicative of operational status of the drill string 120 by the second controller 304, and communicating (682) the rotational speed command 312 to the first controller 302. The method (600) may further comprise receiving (685) input parameters 316, 318, 320 of the stick-slip algorithm 311 by the second controller 304, wherein the rotational speed command 312 may be generated based on the received status information 322, 324 and input parameters 316, 318, 320.

Generating (620) the status information 322, 324 indicative of operational status of the drill string 120 may be performed (640) by the first controller 302, and executing (625) the program code instructions 532 comprising the stick-slip algorithm 311 to generate the rotational speed command 312 may be performed (690) by the first controller 302. The method may further comprise receiving (695) input parameters 316, 318, 320 of the stick-slip algorithm 311 by the first controller 302, wherein the rotational speed command 312 is generated based on the status information 322, 324 and input parameters 316, 318, 320.

In view of the entirety of the present disclosure, including the figures and the claims, a person having ordinary skill in the art will readily recognize that the present disclosure introduces an apparatus comprising a control system for controlling a driver operable to rotate a drill string to form a wellbore extending into a subterranean formation, wherein the control system comprises: a first controller operable to control rotation of the driver; and a second controller communicatively connected with the first controller, wherein during the drilling operations the first and/or second controller is operable to generate a rotational speed command based on status information indicative of operational status of the drill string, and thereby cause the driver to rotate the drill string based on the rotational speed command.

The first controller may be an instance of a first tier of controllers each operable to control a corresponding instance of a plurality of actuators, and the second controller may be an instance of a second tier of controllers each communicatively connected with a corresponding instance of the first tier of controllers. Each instance of the second tier of controllers may be communicatively connected with another instance of the second tier of controllers, such as via a field bus.

The first controller may be or comprise a VFD.

The second controller may be or comprise a PLC.

The first and/or second controller may each or collectively comprise a processor and a memory storing executable program code instructions comprising a stick-slip algorithm, the first and/or second controller may each or collectively be operable to receive input parameters of the stick-slip algorithm, and during the drilling operations the first and/or second controller may execute the program code instructions to generate the rotational speed command based on the status information and input parameters, thereby causing the driver to vary rotational speed of the drill string based on the rotational speed command to reduce rotational waves traveling along the drill string. The control system may comprise a third controller communicatively connected with the second controller, and the third controller, not the first or second controller, may comprise the processor and the memory storing the executable program code instructions comprising the stick-slip algorithm, may be operable to receive the status information and the input parameters, and may execute the program code instructions to generate the rotational speed command based on the status information and input parameters, thereby causing the driver to vary the rotational speed of the drill string based on the rotational speed command to reduce rotational waves traveling along the drill string. During the drilling operations, the rotational speed command may be communicated from the third controller to the first controller via the second controller, and the first controller may be operable to cause the driver to vary the rotational speed of the drill string based on the rotational speed command to reduce the rotational waves traveling along the drill string. The third controller may be communicatively connected with the second controller via a data bus. The third controller may be communicatively connected with the second controller via a virtual communication network. The third controller may be or comprise a PC or an industrial computer (IPC).

The second controller may comprise the processor and the memory storing executable program code instructions comprising the stick-slip algorithm, the second controller may be operable to receive the status information and input parameters, and during the drilling operations the second controller may execute the program code instructions causing the second controller to generate the rotational speed command based on the status information and input parameters, the rotational speed command may be communicated from the second controller to the first controller, and the first controller may cause the driver to vary the rotational speed of the drill string based on the rotational speed command to reduce the rotational waves traveling along the drill string. The second controller may be operable to receive the input parameters, and the first controller may be operable to receive the input parameters from the second controller.

The first controller may comprise the processor and the memory storing executable program code instructions comprising the stick-slip algorithm, the first controller may be operable to receive the input parameters, the first controller may be operable to generate the status information, and during the drilling operations the first controller may execute the program code instructions causing the first controller to generate the rotational speed command based on the status information and input parameters, and the first controller may be operable to cause the driver to vary the rotational speed of the drill string based on the rotational speed command to reduce the rotational waves traveling along the drill string.

The input parameters may be indicative of at least one of: intended rotational average speed of the drill string during drilling operations; a physical characteristic of the drill string; and a numerical parameter of the stick-slip algorithm.

The first and/or second controller may be operable to receive the input parameters from a human operator via an HMI.

The status information may be a first status information indicative of operational status of the drill string at a wellsite surface from which the wellbore extends, and during drilling operations: the first and/or second controller may be operable to generate the rotational speed command at least partially based on second status information indicative of operational status of the drill string downhole; the generated rotational speed command may cause the driver to rotate the drill string at a substantially constant rotational speed when the second status information is indicative that no rotational waves are traveling along the drill string; and the generated rotational speed command may cause the driver to vary the rotational speed of the drill string to reduce the rotational waves traveling along the drill string when the second status information is indicative that the rotational waves are traveling along the drill string. The control system may comprise a sensor communicatively connected with the first and/or second controller, and the sensor may be operable to generate the second status information. The sensor may be disposed downhole within the drill string.

The input parameters may comprise numerical parameters of the stick-slip algorithm, the status information may be a first status information indicative of operational status of the drill string at a wellsite surface from which the wellbore extends, and during drilling operations the first and/or second controller may be operable to: receive second status information indicative of operational status of the drill string downhole; and change one or more of the numerical parameters of the stick-slip algorithm to change the rotational speed command being generated by the first and/or second controller and thereby cause the rotational waves traveling along the drill string to be reduced when the second status information is indicative that the rotational waves traveling along the drill string are not being reduced.

The status information may be indicative of at least one of: rotational speed of the drill string; and torque applied to the tool string by the driver.

The first controller may be operable to generate the status information during drilling operations.

The control system may further comprise a sensor operable to generate the status information, and the sensor may be communicatively connected with the first and/or second controller. The sensor may be a first sensor disposed at a wellsite surface from which the wellbore extends, the status information may be a first status information indicative of operational status of the drill string at the wellsite surface, the control system may further comprise a second sensor disposed downhole within the drill string and communicatively connected with the first and/or second controller, and during drilling operations: the second sensor may be operable to generate second status information indicative of operational status of the drill string downhole; and the first and/or second controller may be operable to generate the rotational speed command based on the first and second status information.

The present disclosure also introduces an apparatus comprising a control system operable to control a well construction system, wherein the control system comprises: (A) a first tier of controllers each operable to control a corresponding actuator of the well construction system, wherein the first tier of controllers comprise a first controller operable to control rotation of a driver operable to rotate a drill string to form a wellbore extending into a subterranean formation; (B) a second tier of controllers each communicatively connected with a corresponding instance of the first tier of controllers, wherein the second tier of controllers comprise a second controller communicatively connected with the first controller; and (C) a third controller communicatively connected with each instance of the second tier of controllers, wherein the first, second, and/or third controller comprises a processor and a memory storing executable program code instructions comprising a stick-slip algorithm, wherein the first, second, and/or third controller is operable to receive input parameters of the stick-slip algorithm, and wherein during drilling operations the first, second, and/or third controller is operable to: (1) execute the program code instructions to generate a rotational speed command based on the input parameters and on status information indicative of operational status of the drill string; and thereby (2) cause the driver to vary rotational speed of the drill string based on the rotational speed command to reduce rotational waves traveling along the drill string.

Each instance of the second tier of controllers may be communicatively connected with another instance of the second tier of controllers, such as via a field bus.

The third controller may be communicatively connected with each instance of the second tier of controllers via a data bus.

The third controller may be communicatively connected with one or more instances of the second tier of controllers via a virtual communication network.

The first controller may be or comprise a VFD.

The second controller may be or comprise a PLC.

The third controller may be or comprise a PC or an IPC.

The third controller may comprise the processor and the memory storing executable program code instructions comprising the stick-slip algorithm, the third controller may be operable to receive the status information and input parameters, and during the drilling operations: the third controller may be operable to execute the program code instructions causing the third controller to generate the rotational speed command based on the status information and input parameters; the rotational speed command may be communicated from the third controller to the first controller via the second controller; and the first controller may be operable to cause the driver to vary the rotational speed of the drill string based on the rotational speed command to reduce the rotational waves traveling along the drill string.

The second controller may comprise the processor and the memory storing executable program code instructions comprising the stick-slip algorithm, the second controller may be operable to receive the status information and input parameters, and during the drilling operations: the second controller may be operable to execute the program code instructions causing the second controller to generate the rotational speed command based on the status information and input parameters; the rotational speed command may be communicated from the second controller to the first controller; and the first controller may be operable to cause the driver to vary the rotational speed of the drill string based on the rotational speed command to reduce the rotational waves traveling along the drill string. The third controller may be operable to receive the input parameters from a human wellsite operator, and the second controller may be operable to receive the input parameters from the third controller.

The first controller may comprise the processor and the memory storing executable program code instructions comprising the stick-slip algorithm, the first controller may be operable to receive the input parameters, and during the drilling operations: the first controller may be operable to generate the status information; the first controller may be operable to execute the program code instructions causing the first controller to generate the rotational speed command based on the status information and input parameters; and the first controller may be operable to cause the driver to vary the rotational speed of the drill string based on the rotational speed command to reduce the rotational waves traveling along the drill string.

The input parameters may be indicative of at least one of: intended rotational average speed of the drill string during drilling operations; a physical characteristic of the drill string; and a numerical parameter of the stick-slip algorithm.

The first, second, and/or third controller may be operable to receive the input parameters from a human operator via an HMI.

The status information may be indicative of at least one of: rotational speed of the drill string; and torque applied to the tool string by the driver.

The first controller may be operable to generate the status information during drilling operations.

The control system may further comprise a sensor operable to generate the status information, and the sensor may be communicatively connected with the first, second, and/or third controller. The sensor may be a first sensor disposed at a wellsite surface from which the wellbore extends, the status information may be a first status information indicative of operational status of the drill string at the wellsite surface, the control system may further comprise a second sensor disposed downhole within the drill string and communicatively connected with the first, second, and/or third controller, and during drilling operations: the second sensor may be operable to generate second status information indicative of operational status of the drill string downhole; and the first, second, and/or third controller may be operable to generate the rotational speed command based on the input parameters, the first status information, and the second status information.

The status information may be a first status information indicative of operational status of the drill string at a wellsite surface from which the wellbore extends, and during drilling operations: the first, second, and/or third controller may be operable to generate the rotational speed command at least partially based on second status information indicative of operational status of the drill string downhole; the generated rotational speed command may cause the driver to rotate the drill string at a substantially constant rotational speed when the second status information is indicative that no rotational waves are traveling along the drill string; and the generated rotational speed command may cause the driver to vary the rotational speed of the drill string to reduce the rotational waves traveling along the drill string when the second status information is indicative that the rotational waves are traveling along the drill string. The control system may further comprise a sensor communicatively connected with the first, second, and/or third controller, and the sensor may be operable to generate the second status information. The sensor may be disposed downhole within the drill string.

The input parameters may comprise numerical parameters of the stick-slip algorithm, the status information may be a first status information indicative of operational status of the drill string at a wellsite surface from which the wellbore extends, and during drilling operations the first, second, and/or third controller may be operable to: receive second status information indicative of operational status of the drill string downhole; and change one or more of the numerical parameters of the stick-slip algorithm to change the rotational speed command being generated by the first, second, and/or third controller and thereby cause the driver to vary the rotational speed of the drill string to reduce the rotational waves traveling along the drill string when the second status information is indicative that the rotational waves traveling along the drill string are not being reduced.

The present disclosure also introduces a method comprising: operating a first controller to cause a driver to rotate a drill string to form a wellbore extending into a subterranean formation; operating a second controller communicatively connected with the first controller; operating a third controller communicatively connected with the second controller; generating status information indicative of operational status of the drill string; and executing, by the first, second, and/or third controller, program code instructions comprising a stick-slip algorithm to generate a rotational speed command based on the status information, thereby causing the driver to vary rotational speed of the drill string based on the rotational speed command to reduce rotational waves traveling along the drill string.

The first controller may be an instance of a first tier of controllers each operable to control a corresponding instance of a plurality of actuators, the second controller may be an instance of a second tier of controllers each communicatively connected with a corresponding instance of the first tier of controllers, and the third controller may be communicatively connected with each instance of the second tier of controllers.

The first controller may be or comprise a VFD.

The second controller may be or comprise a PLC.

The third controller may be or comprise a PC or an IPC.

Executing the program code instructions comprising the stick-slip algorithm to generate the rotational speed command may be performed by the third controller, and the method may further comprise: receiving the status information indicative of operational status of the drill string by the third controller; and communicating the rotational speed command to the first controller via the second controller. The method may further comprise receiving input parameters of the stick-slip algorithm by the third controller, and the rotational speed command may be generated based on the received status information and input parameters.

Executing the program code instructions comprising the stick-slip algorithm to generate the rotational speed command may be performed by the second controller, and the method may further comprise: receiving the status information indicative of operational status of the drill string by the second controller; and communicating the rotational speed command to the first controller. The method may further comprise receiving input parameters of the stick-slip algorithm by the second controller, and the rotational speed command may be generated based on the received status information and input parameters.

Generating the status information indicative of operational status of the drill string may be performed by the first controller, and executing the program code instructions comprising the stick-slip algorithm to generate the rotational speed command may be performed by the first controller. The method may further comprise receiving input parameters of the stick-slip algorithm by the first controller, and the rotational speed command may be generated based on the status information and input parameters.

The method may further comprise receiving input parameters of the stick-slip algorithm by the first, second, and/or third controller, and the rotational speed command may be generated based on the status information and input parameters. The method may further comprise entering the input parameters into the first, second, and/or third controller by a human operator. The input parameters may be indicative of at least one of: intended rotational average speed of the drill string during drilling operations; a physical characteristic of the drill string; and a numerical parameter of the stick-slip algorithm.

Generating the status information indicative of operational status of the drill string may be performed by the first controller.

Generating the status information indicative of operational status of the drill string may be performed by a sensor disposed in association with the driver and/or drill string.

The status information may be indicative of at least one of: rotational speed of the drill string; and torque applied to the tool string by the driver.

The status information may comprise first status information indicative of operational status of the drill string at a wellsite surface from which the wellbore extends, the method may further comprise generating second status information indicative of operational status of the drill string downhole within the wellbore, and the rotational speed command may be generated based on the first and second status information. The generated rotational speed command may cause the driver to rotate the drill string at a substantially constant rotational speed when the second status information is indicative that no rotational waves are traveling along the drill string, and the generated rotational speed command may cause the driver to vary the rotational speed of the drill string to reduce the rotational waves traveling along the drill string when the second status information is indicative that the rotational waves are traveling along the drill string. The stick-slip algorithm may comprise numerical parameters, and executing (by the first, second, and/or third controller) program code instructions may further comprise, when the second status information is indicative that the rotational waves traveling along the drill string are not being reduced, changing one or more of the numerical parameters of the stick-slip algorithm to change the rotational speed command being generated thereby causing the driver to vary rotational speed of the drill string to reduce the rotational waves traveling along the drill string.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a control system operable to control a well construction system, wherein the control system comprises:

a first tier of controllers each operable to control a corresponding actuator of the well construction system, wherein the first tier of controllers comprise a first controller operable to control rotation of a driver operable to rotate a drill string to form a wellbore extending into a subterranean formation;

a second tier of controllers each communicatively connected with a corresponding instance of the first tier of controllers, wherein the second tier of controllers comprise a second controller communicatively connected with the first controller; and a third controller communicatively connected with each instance of the second tier of controllers, wherein the first, second, and/or third controller comprises a processor and a memory storing executable program code instructions comprising a stick-slip algorithm, wherein the first, second, and/or third controller is operable to receive input parameters of the stick-slip algorithm, and wherein during drilling operations the first, second, and/or third controller is operable to:

execute the program code instructions to generate a rotational speed command based on the input parameters and on status information indicative of operational status of the drill string; and thereby cause the driver to vary rotational speed of the drill string based on the rotational speed command to reduce rotational waves traveling along the drill string.

2. The apparatus of claim 1 wherein each instance of the second tier of controllers is communicatively connected with another instance of the second tier of controllers.

3. The apparatus of claim 1 wherein each instance of the second tier of controllers is communicatively connected with another instance of the second tier of controllers via a field bus.

4. The apparatus of claim 1 wherein the third controller is communicatively connected with each instance of the second tier of controllers via a data bus.

5. The apparatus of claim 1 wherein the third controller is communicatively connected with one or more instances of the second tier of controllers via a virtual communication network.

6. The apparatus of claim 1 wherein the first controller is or comprises a variable frequency drive (VFD).

7. The apparatus of claim 1 wherein the second controller is or comprises a programmable logic controller (PLC).

8. The apparatus of claim 1 wherein the third controller is or comprises a personal computer (PC) or an industrial computer (IPC).

9. The apparatus of claim 1 wherein the third controller comprises the processor and the memory storing executable program code instructions comprising the stick-slip algorithm, wherein the third controller is operable to receive the status information and input parameters, and wherein during the drilling operations:

the third controller is operable to execute the program code instructions causing the third controller to generate the rotational speed command based on the status information and input parameters;

the rotational speed command is communicated from the third controller to the first controller via the second controller; and the first controller is operable to cause the driver to vary the rotational speed of the drill string based on the rotational speed command to reduce the rotational waves traveling along the drill string.

10. The apparatus of claim 1 wherein the second controller comprises the processor and the memory storing executable program code instructions comprising the stick-slip algorithm, wherein the second controller is operable to receive the status information and input parameters, and wherein during the drilling operations:

the second controller is operable to execute the program code instructions causing the second controller to generate the rotational speed command based on the status information and input parameters;

the rotational speed command is communicated from the second controller to the first controller; and the first controller is operable to cause the driver to vary the rotational speed of the drill string based on the rotational speed command to reduce the rotational waves traveling along the drill string.

11. The apparatus of claim 10 wherein the third controller is operable to receive the input parameters from a human wellsite operator, and wherein the second controller is operable to receive the input parameters from the third controller.

12. The apparatus of claim 1 wherein the first controller comprises the processor and the memory storing executable program code instructions comprising the stick-slip algorithm, wherein the first controller is operable to receive the input parameters, and wherein during the drilling operations:

the first controller is operable to generate the status information;

the first controller is operable to execute the program code instructions causing the first controller to generate the rotational speed command based on the status information and input parameters; and the first controller is operable to cause the driver to vary the rotational speed of the drill string based on the rotational speed command to reduce the rotational waves traveling along the drill string.

13. The apparatus of claim 1 wherein the input parameters are indicative of at least one of:

intended rotational average speed of the drill string during drilling operations;

a physical characteristic of the drill string; and a numerical parameter of the stick-slip algorithm.

14. The apparatus of claim 1 wherein the first, second, and/or third controller is operable to receive the input parameters from a human operator via a human machine interface (HMI).

15. The apparatus of claim 1 wherein the status information is indicative of at least one of:

rotational speed of the drill string; and torque applied to the tool string by the driver.

16. The apparatus of claim 1 wherein the first controller is operable to generate the status information during drilling operations.

17. The apparatus of claim 1 wherein the control system further comprises a sensor operable to generate the status information, and wherein the sensor is communicatively connected with the first, second, and/or third controller.

18. The apparatus of claim 17 wherein:

the sensor is a first sensor disposed at a wellsite surface from which the wellbore extends;

the status information is a first status information indicative of operational status of the drill string at the wellsite surface;

the control system further comprises a second sensor disposed downhole within the drill string and communicatively connected with the first, second, and/or third controller; and during drilling operations:

the second sensor is operable to generate second status information indicative of operational status of the drill string downhole; and the first, second, and/or third controller is operable to generate the rotational speed command based on the input parameters, the first status information, and the second status information.

19. The apparatus of claim 1 wherein the status information is a first status information indicative of operational status of the drill string at a wellsite surface from which the wellbore extends, and wherein during drilling operations:

the first, second, and/or third controller is operable to generate the rotational speed command at least partially based on second status information indicative of operational status of the drill string downhole;

the generated rotational speed command causes the driver to rotate the drill string at a substantially constant rotational speed when the second status information is indicative that no rotational waves are traveling along the drill string; and the generated rotational speed command causes the driver to vary the rotational speed of the drill string to reduce the rotational waves traveling along the drill string when the second status information is indicative that the rotational waves are traveling along the drill string.

20. The apparatus of claim 19 wherein the control system further comprises a sensor communicatively connected with the first, second, and/or third controller, and wherein the sensor is operable to generate the second status information.

21. The apparatus of claim 19 wherein the sensor is disposed downhole within the drill string.

22. The apparatus of claim 1 wherein:

the input parameters comprise numerical parameters of the stick-slip algorithm;

the status information is a first status information indicative of operational status of the drill string at a wellsite surface from which the wellbore extends; and during drilling operations the first, second, and/or third controller is operable to:

receive second status information indicative of operational status of the drill string downhole; and change one or more of the numerical parameters of the stick-slip algorithm to change the rotational speed command being generated by the first, second, and/or third controller and thereby cause the driver to vary the rotational speed of the drill string to reduce the rotational waves traveling along the drill string when the second status information is indicative that the rotational waves traveling along the drill string are not being reduced.

* * * * *